US009311841B2

(12) United States Patent
Nakagawa et al.

(10) Patent No.: US 9,311,841 B2
(45) Date of Patent: Apr. 12, 2016

(54) MULTI-PRIMARY COLOUR DISPLAY DEVICE

(75) Inventors: Shinji Nakagawa, Osaka (JP); Hiroyuki Furukawa, Osaka (JP); Kazuyoshi Yoshiyama, Osaka (JP); Yasuhiro Yoshida, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 105 days.

(21) Appl. No.: 14/343,186

(22) PCT Filed: Sep. 4, 2012

(86) PCT No.: PCT/JP2012/072403

§ 371 (c)(1),
(2), (4) Date: Mar. 6, 2014

(87) PCT Pub. No.: WO2013/035679

PCT Pub. Date: Mar. 14, 2013

(65) Prior Publication Data

US 2014/0225940 A1 Aug. 14, 2014

(30) Foreign Application Priority Data

Sep. 7, 2011 (JP) ..... 2011-195451

(51) Int. Cl.
*G09G 5/10* (2006.01)
*G09G 3/20* (2006.01)
*G09G 3/36* (2006.01)

(52) U.S. Cl.
CPC ..... *G09G 3/2003* (2013.01); *G09G 3/3607* (2013.01); *G09G 2300/0452* (2013.01);
(Continued)

(58) Field of Classification Search
CPC ..... G09G 3/3607; G09G 2300/0452; G09G 2320/0242
USPC ..... 345/690
See application file for complete search history.

(56) References Cited

U.S. PATENT DOCUMENTS

2002/0113195 A1* 8/2002 Osada ..... G06T 3/4007 250/208.1

(Continued)

FOREIGN PATENT DOCUMENTS

JP 2003-006630 A 1/2003
WO 2006/018926 A1 2/2006

(Continued)

OTHER PUBLICATIONS

Official Communication issued in International Patent Application No. PCT/JP2012/072403, mailed on Dec. 11, 2012.

(Continued)

*Primary Examiner* — Jonathan Blancha
(74) *Attorney, Agent, or Firm* — Keating & Bennett, LLP

(57) ABSTRACT

This multi-primary-color display device (100) includes a multi-primary-color display panel (10) and a signal converter (20). The display device assigns a plurality of subpixels that form each pixel to a plurality of virtual pixels and is able to conduct a display operation using each of the plurality of virtual pixels as a minimum color display unit. The signal converter (20) includes: a low-frequency multi-primary-color signal generating section (21) which generates a low-frequency multi-primary-color signal; a high-frequency luminance signal generating section (22) which generates a high-frequency luminance signal; and a rendering processing section (23) which performs rendering processing on the plurality of virtual pixels based on the low-frequency multi-primary-color signal and the high-frequency luminance signal. The signal converter (20) further includes a magnitude of correction calculating section (24) which calculates, based on an input image signal, the magnitude of correction to be made on the high-frequency luminance signal during the rendering processing.

13 Claims, 14 Drawing Sheets

(52) U.S. Cl.
CPC ..... *G09G2320/0242* (2013.01); *G09G 2340/0457* (2013.01); *G09G 2340/06* (2013.01); *G09G 2360/16* (2013.01)

(56) References Cited

U.S. PATENT DOCUMENTS

| | | | | |
|---|---|---|---|---|
| 2004/0263528 | A1* | 12/2004 | Murdoch | G09G 3/3208 345/600 |
| 2007/0268208 | A1 | 11/2007 | Okada et al. | |
| 2009/0167657 | A1 | 7/2009 | Tomizawa | |
| 2009/0232395 | A1* | 9/2009 | Sumiya | H04N 5/208 382/167 |
| 2010/0053235 | A1 | 3/2010 | Tomizawa et al. | |

FOREIGN PATENT DOCUMENTS

| | | | |
|---|---|---|---|
| WO | 2007/097080 | A1 | 8/2007 |
| WO | 2008/065935 | A1 | 6/2008 |
| WO | 2012/067037 | A1 | 5/2012 |
| WO | 2012/067038 | A1 | 5/2012 |

OTHER PUBLICATIONS

Pointer, "The Gamut of Real Surface Colours", Color Research and Application, vol. 5, No. 3, 1980, pp. 145-155.

English translation of Official Communication issued in corresponding International Application PCT/JP2012/072403, mailed on Mar. 20, 2014.

* cited by examiner

FIG. 18

| | | | | | | | | | | | | |
|---|---|---|---|---|---|---|---|---|---|---|---|---|
| LOW-FREQUENCY COMPONENT | $L(2n-2,4)$ | $L(2n-2,5)$ | $L(2n-2,6)$ | $L(2n,1)$ | $L(2n,2)$ | $L(2n,3)$ | $L(2n,4)$ | $L(2n,5)$ | $L(2n,6)$ | $L(2n+2,1)$ | $L(2n+2,2)$ | $L(2n+2,3)$ |
| | $L(2n-1,4)$ | $L(2n-1,5)$ | $L(2n-1,6)$ | $L(2n-1,1)$ | $L(2n-1,2)$ | $L(2n-1,3)$ | $L(2n+1,4)$ | $L(2n+1,5)$ | $L(2n+1,6)$ | $L(2n+1,1)$ | $L(2n+1,2)$ | $L(2n+1,3)$ |
| HIGH-FREQUENCY COMPONENT | $H(2n-2)$ | | | $H(2n)$ | | | | | | $H(2n+2)$ | | |
| | $H(2n-1)$ | | | | | | $H(2n+1)$ | | | | | |
| PIXEL VALUE | $P(2n-2,4)$ | $P(2n-2,5)$ | $P(2n-2,6)$ | $P(2n,1)$ | $P(2n,2)$ | $P(2n,3)$ | $P(2n,4)$ | $P(2n,5)$ | $P(2n,6)$ | $P(2n+2,1)$ | $P(2n+2,2)$ | $P(2n+2,3)$ |
| | $P(2n-1,4)$ | $P(2n-1,5)$ | $P(2n-1,6)$ | $P(2n-1,1)$ | $P(2n-1,2)$ | $P(2n-1,3)$ | $P(2n+1,4)$ | $P(2n+1,5)$ | $P(2n+1,6)$ | $P(2n+1,1)$ | $P(2n-1,2)$ | $P(2n+1,3)$ |
| FIRST VIRTUAL PIXEL'S WEIGHT | $W(1,4)$ | $W(1,5)$ | $W(1,6)$ | $W(1,1)$ | $W(1,2)$ | $W(1,3)$ | $W(1,4)$ | $W(1,5)$ | $W(1,6)$ | $W(1,1)$ | $W(1,2)$ | $W(1,3)$ |
| SECOND VIRTUAL PIXEL'S WEIGHT | $W(2,4)$ | $W(2,5)$ | $W(2,6)$ | $W(2,1)$ | $W(2,2)$ | $W(2,3)$ | $W(2,4)$ | $W(2,5)$ | $W(2,6)$ | $W(2,1)$ | $W(2,2)$ | $W(2,3)$ |
| VIRTUAL PIXEL RENDERING RESULT | $V(n-1,4)$ | $V(n-1,5)$ | $V(n-1,6)$ | $V(n,1)$ | $V(n,2)$ | $V(n,3)$ | $V(n,4)$ | $V(n,5)$ | $V(n,6)$ | $V(n+1,1)$ | $V(n+1,2)$ | $V(n+1,3)$ |

*FIG. 19*

| PIXEL VALUE | $P(2n,1)$ | $P(2n,2)$ | $P(2n,3)$ | $P(2n,4)$ | $P(2n,5)$ | $P(2n,6)$ |
|---|---|---|---|---|---|---|
| | $P(2n-1,1)$ | $P(2n-1,2)$ | $P(2n-1,3)$ | $P(2n+1,4)$ | $P(2n+1,5)$ | $P(2n+1,6)$ |
| FIRST VIRTUAL PIXEL'S WEIGHT | 0 | 0.5 | 1 | 1 | 0.5 | 0 |
| SECOND VIRTUAL PIXEL'S WEIGHT | 1 | 0.5 | 0 | 0 | 0.5 | 1 |
| VIRTUAL PIXEL RENDERING RESULT | $V(n,1) = P(2n-1,1)$ | $V(n,2) = [P(2n-1,2)+P(2n,2)]/2$ | $V(n,3) = P(2n,3)$ | $V(n,4) = P(2n,4)$ | $V(n,5) = [P(2n,5)+P(2n+1,5)]/2$ | $V(n,6) = P(2n+1,6)$ |

FIG.21

| | | | | | | | | | | | | |
|---|---|---|---|---|---|---|---|---|---|---|---|---|
| LOW-FREQUENCY COMPONENT | $L(2n-2,4)$ | $L(2n-2,5)$ | $L(2n-2,6)$ | $L(2n,1)$ | $L(2n,2)$ | $L(2n,3)$ | $L(2n,4)$ | $L(2n,5)$ | $L(2n,6)$ | $L(2n+2,1)$ | $L(2n+2,2)$ | $L(2n+2,3)$ |
| | $L(2n-1,4)$ | $L(2n-1,5)$ | $L(2n-1,6)$ | $L(2n-1,1)$ | $L(2n-1,2)$ | $L(2n-1,3)$ | $L(2n+1,4)$ | $L(2n+1,5)$ | $L(2n+1,6)$ | $L(2n+1,1)$ | $L(2n+1,2)$ | $L(2n+1,3)$ |
| HIGH-FREQUENCY COMPONENT | $H(2n-2)$ | | | $H(2n)$ | | | | | | $H(2n+2)$ | | |
| | $H(2n-1)$ | | | | | | $H(2n+1)$ | | | | | |
| MAGNITUDE OF CORRECTION ON HIGH-FREQUENCY COMPONENT | $C(2n-2)$ | | | $C(2n)$ | | | | | | $C(2n+2)$ | | |
| | $C(2n-1)$ | | | | | | $C(2n+1)$ | | | | | |
| PIXEL VALUE | $P(2n-2,4)$ | $P(2n-2,5)$ | $P(2n-2,6)$ | $P(2n,1)$ | $P(2n,2)$ | $P(2n,3)$ | $P(2n,4)$ | $P(2n,5)$ | $P(2n,6)$ | $P(2n+2,1)$ | $P(2n+2,2)$ | $P(2n+2,3)$ |
| | $P(2n-1,4)$ | $P(2n-1,5)$ | $P(2n-1,6)$ | $P(2n-1,1)$ | $P(2n-1,2)$ | $P(2n-1,3)$ | $P(2n+1,4)$ | $P(2n+1,5)$ | $P(2n+1,6)$ | $P(2n+1,1)$ | $P(2n+1,2)$ | $P(2n+1,3)$ |
| FIRST VIRTUAL PIXEL'S WEIGHT | $W(1,4)$ | $W(1,5)$ | $W(1,6)$ | $W(1,1)$ | $W(1,2)$ | $W(1,3)$ | $W(1,4)$ | $W(1,5)$ | $W(1,6)$ | $W(1,1)$ | $W(1,2)$ | $W(1,3)$ |
| SECOND VIRTUAL PIXEL'S WEIGHT | $W(2,4)$ | $W(2,5)$ | $W(2,6)$ | $W(2,1)$ | $W(2,2)$ | $W(2,3)$ | $W(2,4)$ | $W(2,5)$ | $W(2,6)$ | $W(2,1)$ | $W(2,2)$ | $W(2,3)$ |
| VIRTUAL PIXEL RENDERING RESULT | $V(n-1,4)$ | $V(n-1,5)$ | $V(n-1,6)$ | $V(n,1)$ | $V(n,2)$ | $V(n,3)$ | $V(n,4)$ | $V(n,5)$ | $V(n,6)$ | $V(n+1,1)$ | $V(n+1,2)$ | $V(n+1,3)$ |

| | | CONVENTIONAL METHOD | | | | COMPARATIVE EXAMPLE | | | | EXAMPLE 1 | | | |
|---|---|---|---|---|---|---|---|---|---|---|---|---|---|
| INPUT IMAGE SIGNAL (THREE-COLOR) | R | 3 | 251 | 3 | 251 | 3 | 251 | 3 | 251 | 3 | 251 | 3 | 251 |
| | G | 183 | 71 | 183 | 71 | 183 | 71 | 183 | 71 | 183 | 71 | 183 | 71 |
| | B | 65 | 189 | 65 | 189 | 65 | 189 | 65 | 189 | 65 | 189 | 65 | 189 |
| LUMINANCE SIGNAL | I | | | | | 127 | 127 | 127 | 127 | 127 | 127 | 127 | 127 |
| THREE-COLOR LOW-FREQUENCY COMPONENT | R | 127 | 127 | 127 | 127 | 127 | 127 | 127 | 127 | 127 | 127 | 127 | 127 |
| | G | 127 | 127 | 127 | 127 | 127 | 127 | 127 | 127 | 127 | 127 | 127 | 127 |
| | B | 127 | 127 | 127 | 127 | 127 | 127 | 127 | 127 | 127 | 127 | 127 | 127 |
| HIGH-FREQUENCY COMPONENT | H | | | | | 0 | 0 | 0 | 0 | 0 | 0 | 0 | 0 |
| MAGNITUDE OF CORRECTION ON HIGH-FREQUENCY COMPONENT | C | | | | | | | | | 0 | 15 | 0 | 15 |

MULTI-PRIMARY COLOUR DISPLAY DEVICE

TECHNICAL FIELD

The present invention relates to a display device and more particularly relates to a multi-primary-color display device which conducts a display operation using four or more primary colors.

BACKGROUND ART

In a general display device, a single pixel is comprised of three subpixels respectively representing red, green and blue, which are the three primary colors of light, thereby conducting a display operation in colors.

A conventional display device, however, can reproduce colors that fall within only a narrow range (which is usually called a "color reproduction range"), which is a problem. If the color reproduction range is narrow, then some of the object colors (i.e., the colors of various objects existing in Nature, see Non-Patent Document No. 1) cannot be represented. Thus, to broaden the color reproduction range of display devices, a technique for increasing the number of primary colors for use to perform a display operation has recently been proposed.

For example, Patent Document No. 1 discloses a display device which conducts a display operation using six primary colors, and also discloses a display device which conducts a display operation using four primary colors and a display device which conducts a display operation using five primary colors as well. An example of such a display device which conducts a display operation using six primary colors is shown in FIG. 25. In the display device 800 shown in FIG. 25, a single pixel P is comprised of red, green, blue, cyan, magenta and yellow subpixels R, G, B, C, M and Ye. This display device 800 conducts a display operation in colors by mixing together the six primary colors of red, green, blue, cyan, magenta and yellow that are represented by these six subpixels.

By increasing the number of primary colors for use to conduct a display operation (i.e., by performing a display operation using four or more primary colors), the color reproduction range can be broadened compared to a conventional display device that uses only the three primary colors for display purposes. Such a display device that conducts a display operation using four or more primary colors will be referred to herein as a "multi-primary-color display device". On the other hand, a display device that conducts a display operation using the three primary colors (i.e., a typical conventional display device) will be referred to herein as a "three-primary-color display device".

CITATION LIST

Patent Literature

Patent Document No. 1: PCT International Application Publication No. 2006/018926

Non-Patent Literature

Non-Patent Document No. 1: M. R. Pointer, "The Gamut of Real Surface Colors", Color Research and Application, Vol. 5, No. 3, pp. 145-155 (1980)

SUMMARY OF INVENTION

Technical Problem

However, to enable a multi-primary-color display device to display an image with as high a resolution as a three-primary-color display device's, if the screen size is the same, the device structure needs to have an even smaller size, which would cause a increase in manufacturing cost. The reason is that in a multi-primary-color display device, the number of subpixels per pixel increases from three to four or more, and therefore, to realize the same number of pixels at the same screen size, the size of each subpixel should be cut down compared to a three-primary-color display device. Specifically, if the number of primary colors for use to conduct a display operation is m (where $m \geq 4$), the size of each subpixel should be reduced to 3/m. For example, in a multi-primary-color display device which conducts a display operation using six primary colors, the size of each subpixel should be reduced to a half (=3/6).

The present inventors perfected our invention in order to overcome these problems by providing a multi-primary-color display device which can display an image with a resolution that is equal to or higher than that of a three-primary-color display device without reducing the size of each subpixel compared to the three-primary-color display device.

Solution to Problem

A multi-primary-color display device according to an embodiment of the present invention includes a plurality of pixels which are arranged in columns and rows to form a matrix pattern. Each of the plurality of pixels is comprised of a plurality of subpixels that represent mutually different colors and that include at least four subpixels. The device further includes: a multi-primary-color display panel in which each of the plurality of pixels is comprised of the plurality of subpixels; and a signal converter which converts an input image signal representing the three primary colors into a multi-primary-color image signal representing four or more primary colors. The display device assigns the plurality of subpixels that form each pixel to a plurality of virtual pixels and is able to conduct a display operation using each of the plurality of virtual pixels as a minimum color display unit. The signal converter includes: a low-frequency multi-primary-color signal generating section which generates, based on the input image signal, a low-frequency multi-primary-color signal that is a signal obtained by converting low-frequency components of the input image signal into multiple primary colors; a high-frequency luminance signal generating section which generates, based on the input image signal, a high-frequency luminance signal that is a signal obtained by converting high-frequency components of the input image signal into a luminance; and a rendering processing section which performs rendering processing on the plurality of virtual pixels based on the low-frequency multi-primary-color signal and the high-frequency luminance signal. The signal converter further includes a magnitude of correction calculating section which calculates, based on the input image signal, the magnitude of correction to be made on the high-frequency luminance signal during the rendering processing.

In one preferred embodiment, the magnitude of correction calculating section calculates the magnitude of correction based on the hue of a color specified by the input image signal.

In one preferred embodiment, the magnitude of correction to be calculated by the magnitude of correction calculating section has a positive value if the color specified by the input image signal is an expansive color and has a negative value if the color specified by the input image signal is a contractive color.

In one preferred embodiment, if the color specified by the input image signal is an achromatic color, the magnitude of correction calculated by the magnitude of correction calculating section is zero.

In one preferred embodiment, the low-frequency multi-primary-color signal generating section includes: a low-frequency component extracting section which extracts low-frequency components from the input image signal; and a multi-primary-color converting section which converts the low-frequency components that have been extracted by the low-frequency component extracting section into multiple primary colors.

In one preferred embodiment, the high-frequency luminance signal generating section includes: a luminance converting section which generates a luminance signal by subjecting the input image signal to a luminance conversion; and a high-frequency component extracting section which extracts, as the high-frequency luminance signal, high-frequency components of the luminance signal that have been generated by the luminance converting section.

In one preferred embodiment, the multi-primary-color display device of the present invention can change the pattern of assigning the plurality of subpixels to the plurality of virtual pixels.

In one preferred embodiment, according to one assignment pattern, the plurality of subpixels are assigned to two virtual pixels. According to another assignment pattern, the plurality of subpixels are assigned to three virtual pixels.

In one preferred embodiment, each of the plurality of virtual pixels is comprised of some of the plurality of subpixels.

In one preferred embodiment, each of the plurality of virtual pixels is comprised of at least two of the plurality of subpixels.

In one preferred embodiment, the at least two subpixels that form each of the plurality of virtual pixels include a subpixel to be shared with another virtual pixel.

In one preferred embodiment, the rows run substantially parallel to a horizontal direction on a display screen, and in each of the plurality of pixels, the plurality of subpixels are arranged in one row and multiple columns.

In one preferred embodiment, the plurality of subpixels includes red, green and blue subpixels representing the colors red, green and blue, respectively.

In one preferred embodiment, the plurality subpixels further includes at least one of cyan, magenta, yellow and white subpixels representing the colors cyan, magenta, yellow and white, respectively.

In one preferred embodiment, the plurality of subpixels includes another red subpixel representing the color red.

In one preferred embodiment, the multi-primary-color display device of the present invention is a liquid crystal display device.

Advantageous Effects of Invention

An embodiment of the present invention provides a multi-primary-color display device which can display an image with a resolution that is equal to or higher than that of a three-primary-color display device without reducing the size of each subpixel compared to the three-primary-color display device. In addition, according to the present invention, in a situation where a display operation is conducted using a plurality of virtual pixels in order to increase the resolution, the resolution can also be increased effectively even in a region which does have a chromaticity difference but does not have a luminance difference.

BRIEF DESCRIPTION OF DRAWINGS

[FIG. 18] A table showing low-frequency components, high-frequency components, pixel values, weights of respective primary colors at first virtual pixels, weights of respective primary colors at second virtual pixels, and the results of rendering processing with those virtual pixels taken into consideration as for a portion of a certain row of pixels in a situation where the rendering processing is carried out using the signal converter 20' of the comparative example.

[FIG. 19] A table showing the pixel values and results of the rendering processing to be obtained when the $m^{th}$ primary color's weights W(1, m) and W(2, m) of the first and second virtual pixels are set to be certain values.

[FIG. 21] A table showing low-frequency components, high-frequency components, the magnitudes of correction to be made on the high-frequency components, pixel values, weights of respective primary colors at first virtual pixels, weights of respective primary colors at second virtual pixels, and the results of rendering processing with those virtual pixels taken into consideration as for a portion of a certain row of pixels in a situation where the rendering processing is carried out using the signal converter 20 of the liquid crystal display device 100.

DESCRIPTION OF EMBODIMENTS

Hereinafter, embodiments of the present invention will be described with reference to the accompanying drawings. Although a liquid crystal display device will be described as an example in the following description, the present invention does not have to be implemented as a liquid crystal display device but may also be effectively applicable to an organic EL display device and other kinds of display devices as well.

Figure 1:
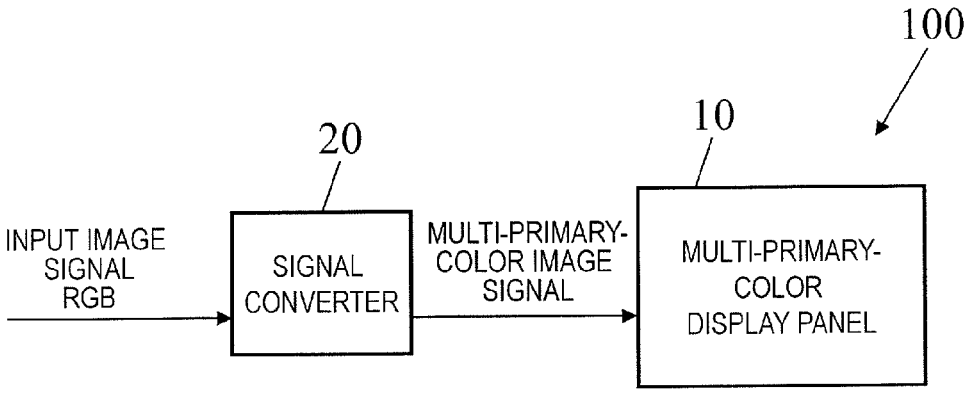
[FIG. 1] A block diagram schematically illustrating a liquid crystal display device (as a multi-primary-color display device) 100 as a preferred embodiment of the present invention.

FIG. 1 illustrates a liquid crystal display device 100 according to this embodiment. As shown in FIG. 1, this liquid crystal display device 100 is a multi-primary-color display device which includes a multi-primary-color display panel 10 and a signal converter 20 and which conducts a display operation using four or more primary colors.

Figure 2:
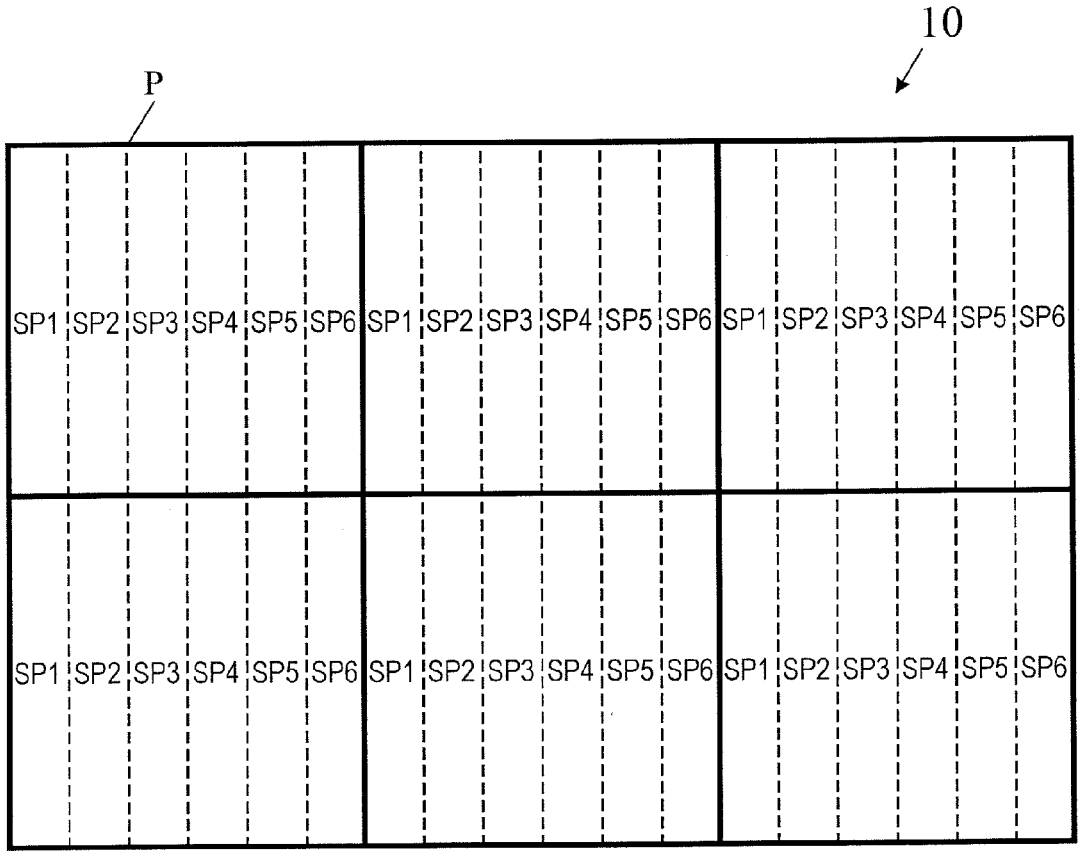
[FIG. 2] Illustrates an exemplary arrangement of subpixels for a multi-primary-color display panel 10 that the liquid crystal display device 100 has.

Although not shown in FIG. 1, the multi-primary-color display panel 10 includes a plurality of pixels which are arranged in columns and rows to form a matrix pattern. Each of the plurality of pixels is comprised of a plurality of subpixels, which include at least four subpixels that represent mutually different primary colors. FIG. 2 illustrates an exemplary specific pixel structure (i.e., arrangement of subpixels) for the multi-primary-color display panel 10.

In the multi-primary-color display panel 10 shown in FIG. 2, each of those pixels P that are arranged in a matrix pattern is comprised of six subpixels SP1 through SP6. In each pixel P, those six subpixels SP1 through SP6 are arranged in one row and six columns. Those six subpixels SP1 through SP6 may be red, green, blue, cyan, magenta and yellow subpixels R, G, B, C, M and Ye representing the colors red, green, blue, cyan, magenta and yellow, respectively.

It should be noted that the multi-primary-color display panel 10 does not have to have the pixel structure shown in FIG. 2. Other exemplary pixel structures for the multi-primary-color display panel 10 are shown in FIGS. 3 and 4.

Figure 3:
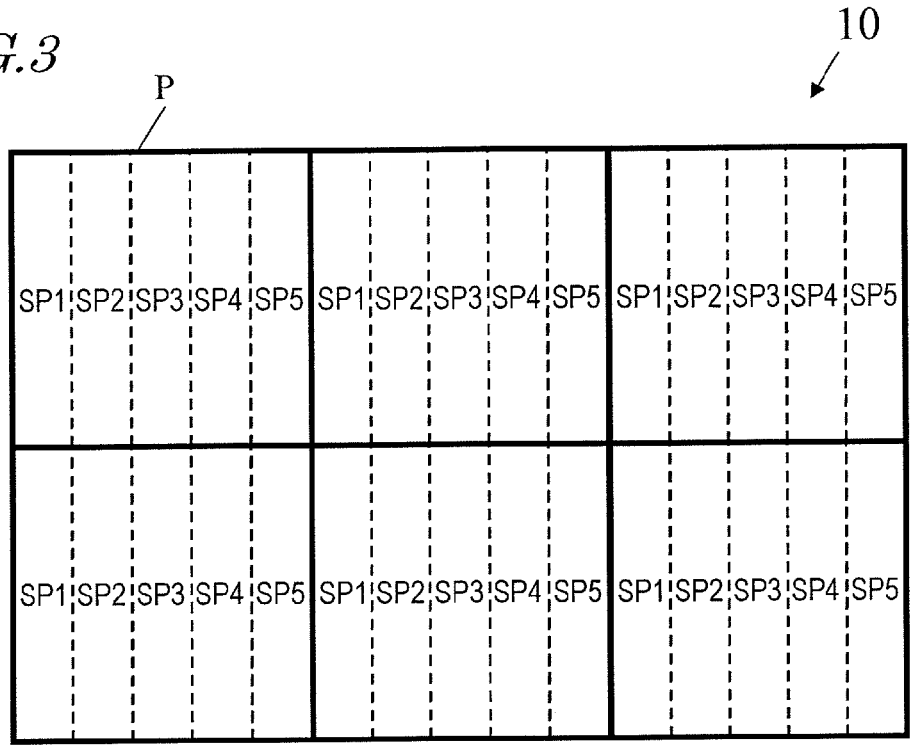
[FIG. 3] Illustrates another exemplary arrangement of subpixels for the multi-primary-color display panel 10 that the liquid crystal display device 100 has.

In the multi-primary-color display panel 10 shown in FIG. 3, each of those pixels P that are arranged in a matrix pattern is comprised of five subpixels SP1 through SP5. In each pixel P, those five subpixels SP1 through SP5 are arranged in one row and five columns. Those five subpixels SP1 through SP5 may be red, green, blue subpixels R, G and B and two of cyan, magenta and yellow subpixels C, M and Ye.

Figure 4:
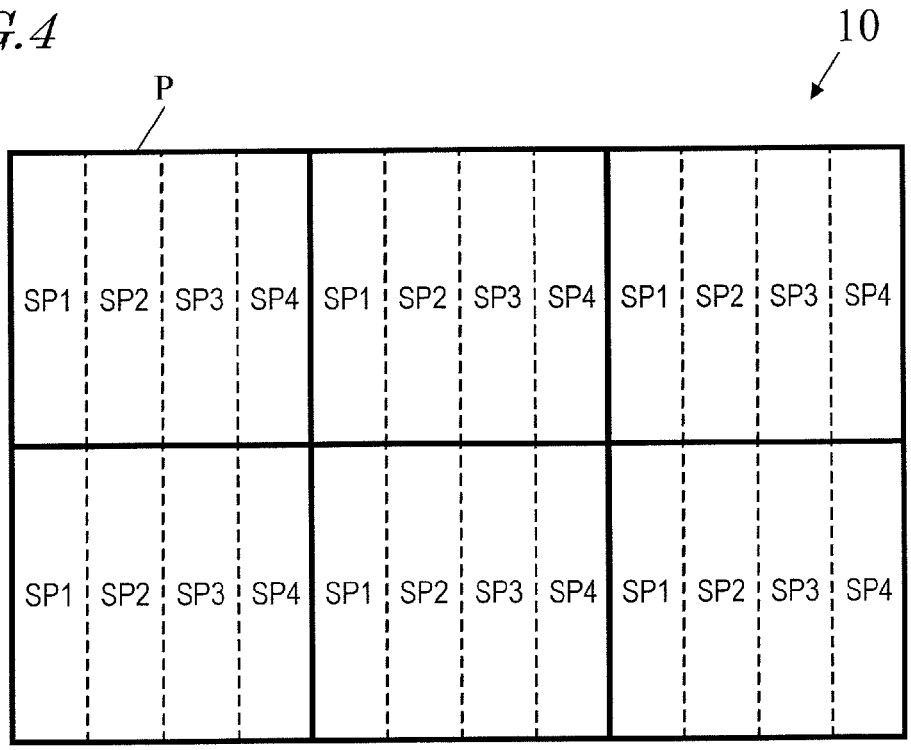
[FIG. 4] Illustrates still another exemplary arrangement of subpixels for the multi-primary-color display panel 10 that the liquid crystal display device 100 has.

In the multi-primary-color display panel 10 shown in FIG. 4, each of those pixels P that are arranged in a matrix pattern is comprised of four subpixels SP1 through SP4. In each pixel P, those four subpixels SP1 through SP4 are arranged in one row and four columns. Those four subpixels SP1 through SP4 may be red, green, blue subpixels R, G and B and one of cyan, magenta and yellow subpixels C, M and Ye.

It should be noted that those subpixels that form a single pixel P do not necessarily consist of subpixels that represent mutually different colors. For example, any of the cyan, magenta and yellow subpixels C, M and Ye may be replaced with another red subpixel R representing the color red. If two red subpixels R are provided for each single pixel P, a brighter color red (i.e., the color red with higher lightness) can be displayed. Alternatively, any of the cyan, magenta and yellow subpixels C, M and Ye may be replaced with a white subpixel W representing the color white. With a white subpixel W provided, the display luminance can be increased in the entire pixel P.

In FIGS. 2 to 4, illustrated are exemplary configurations in which a plurality of subpixels are arranged to form one row and multiple columns in each pixel P. However, in each pixel P, subpixels do not have to be arranged in such a pattern but may also be arranged to form multiple rows and one column, for example. Nevertheless, to increase the resolution effectively in a certain direction, multiple subpixels should be present in that direction in each pixel P. That is why to increase the resolution effectively in the row direction, multiple subpixels should rather be arranged in two or more columns in each pixel P. On the other hand, to increase the resolution effectively in the column direction, multiple subpixels should rather be arranged in two or more rows in each pixel P. Also, since the human eyes have a lower resolution vertically than horizontally, it is recommended that the horizontal resolution be increased to say the least. And typically, the row direction (i.e., a plurality of rows comprised of a plurality of pixels P) is substantially parallel to the horizontal direction on the display screen. That is why it can be said that in a general application, a plurality of subpixels are suitably arranged to form one row and multiple columns in each pixel P. Thus, in the following description, the rows of pixels are supposed to be substantially parallel to the horizontal direction on the display screen and multiple subpixels are supposed to be arranged in one row and multiple columns in each pixel P unless otherwise stated.

As shown in FIG. 1, the signal converter 20 converts an input image signal representing the three primary colors (RGB) into an image signal representing four or more primary colors (which will be referred to herein as a "multi-primary-color image signal"). The multi-primary-color image signal is output from the signal converter 20 to the multi-primary-color display panel 10, thereby conducting a display operation in four or more primary colors. A specific configuration for the signal converter 20 will be described in detail later.

In this description, the total number of pixels P that the multi-primary-color display panel 10 has will be referred to herein as a "panel resolution". For example, if multiple pixels P are arranged to form A rows and B columns, the panel resolution will be referred to herein as "A×B". Also, in this description, the minimum display unit of an input image will also be referred to herein as a "pixel" for convenience sake, and the total number of pixels of an input image will be referred to herein as the "resolution of the input image". Even so, the resolution of an input image comprised of pixels that are arranged in A rows and B columns will also be referred to herein as "A×B".

The liquid crystal display device 100 of this embodiment can conduct a display operation by assigning multiple subpixels that form each pixel P to a plurality of virtual pixels (which will be simply referred to herein as "virtual pixels") and using each of those virtual pixels as a minimum color display unit. Exemplary patterns of assigning multiple subpixels to those virtual pixels are shown in FIGS. 5, 6 and 7.

Figure 5:
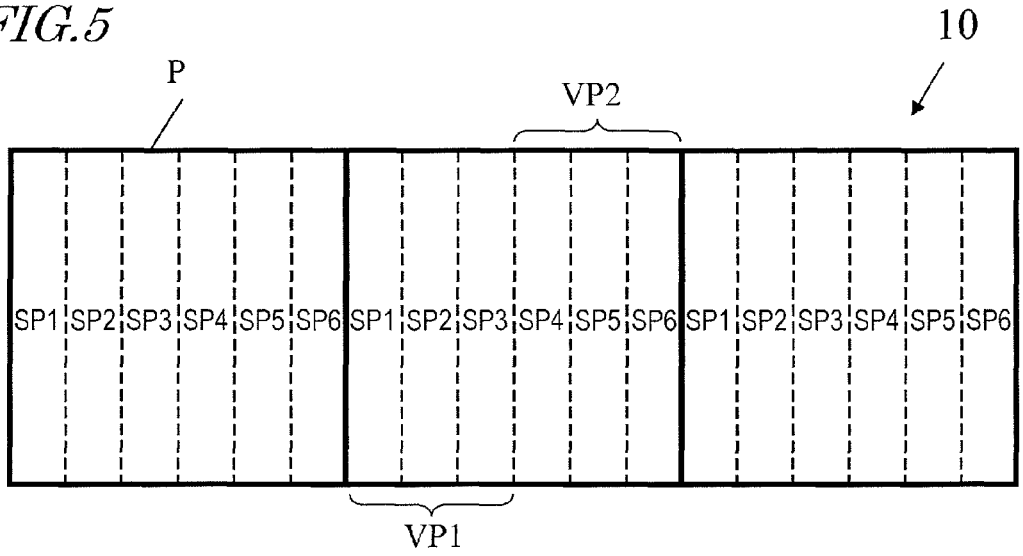
[FIG. 5] Illustrates an exemplary pattern of assigning multiple subpixels to a plurality of virtual pixels.

According to the assignment pattern shown in FIG. 5, six subpixels SP1 through SP6 which form each pixel P are assigned to two virtual pixels (which will be referred to herein as "first and second virtual pixels") VP1 and VP2. The first virtual pixel VP1 consists of three subpixels SP1, SP2 and SP3 among those six subpixels SP1 through SP6. On the other hand, the second virtual pixel VP2 consists of the other three subpixels SP4, SP5 and SP6.

Figure 6:
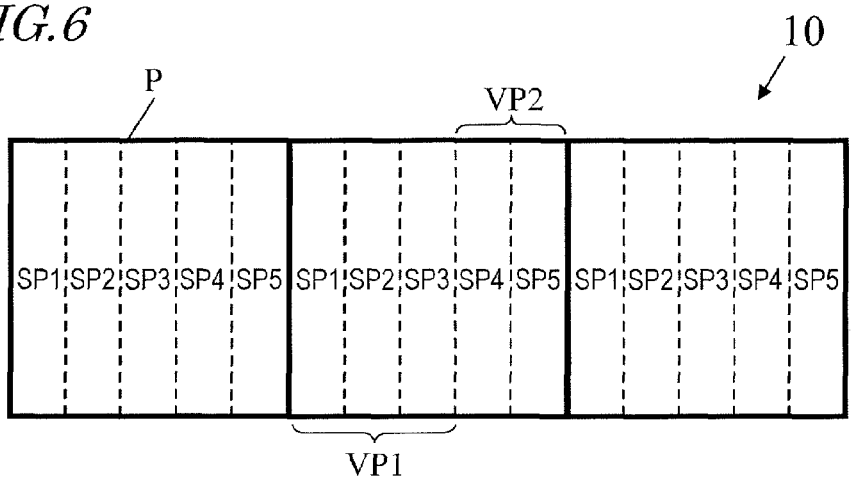
[FIG. 6] Illustrates another exemplary pattern of assigning multiple subpixels to a plurality of virtual pixels.

According to the assignment pattern shown in FIG. 6, five subpixels SP1 through SP5 which form each pixel P are assigned to two virtual pixels (which will be referred to herein as "first and second virtual pixels") VP1 and VP2. The first virtual pixel VP1 consists of three subpixels SP1, SP2 and SP3 among those five subpixels SP1 through SP5. On the other hand, the second virtual pixel VP2 consists of the other two subpixels SP4 and SP5.

Figure 7:
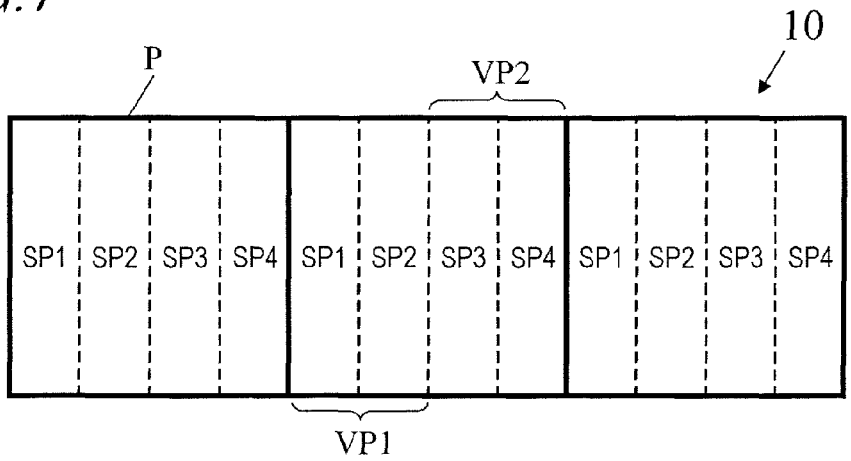
[FIG. 7] Illustrates still another exemplary pattern of assigning multiple subpixels to a plurality of virtual pixels.

According to the assignment pattern shown in FIG. 7, four subpixels SP1 through SP4 which form each pixel P are assigned to two virtual pixels (which will be referred to herein as "first and second virtual pixels") VP1 and VP2. The first virtual pixel VP1 consists of two subpixels SP1 and SP2 among those four subpixels SP1 through SP4. On the other hand, the second virtual pixel VP2 consists of the other two subpixels SP3 and SP4.

Figure 8:
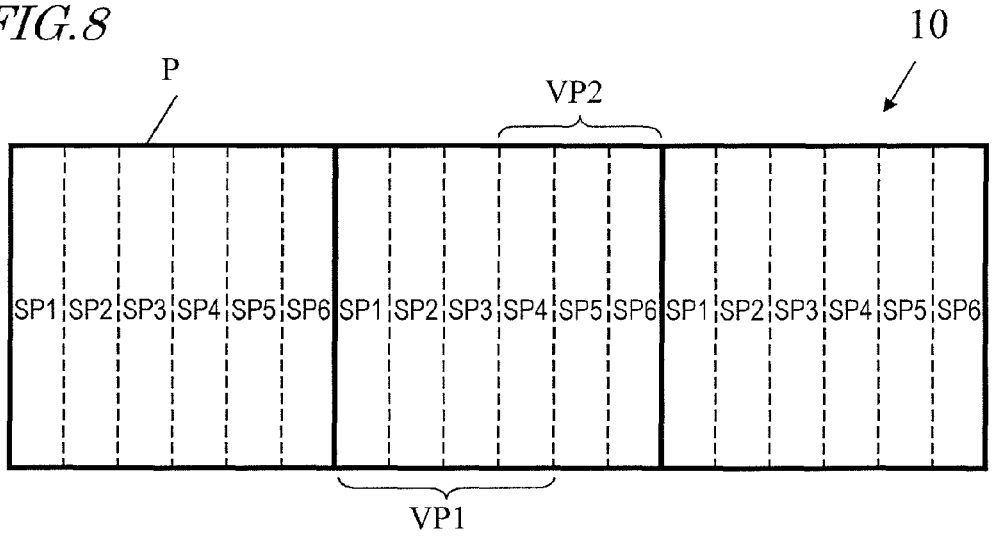
[FIG. 8] Illustrates yet another exemplary pattern of assigning multiple subpixels to a plurality of virtual pixels.
Figure 9:
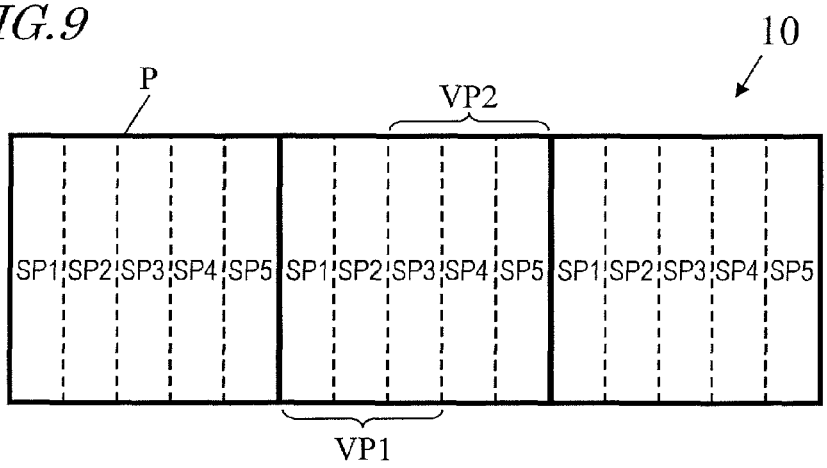
[FIG. 9] Illustrates yet another exemplary pattern of assigning multiple subpixels to a plurality of virtual pixels.
Figure 10:
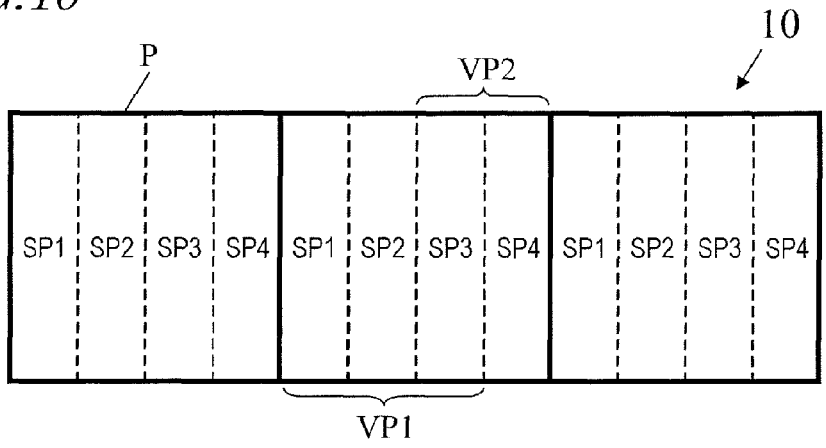
[FIG. 10] Illustrates yet another exemplary pattern of assigning multiple subpixels to a plurality of virtual pixels.

FIGS. 8, 9 and 10 illustrate other exemplary assignment patterns. In the examples shown in FIGS. 8, 9 and 10, at least two subpixels which form each virtual pixel include a subpixel which is shared in common with another virtual pixel, which is a difference from the assignment patterns shown in FIGS. 5, 6 and 7.

According to the assignment pattern shown in FIG. 8, six subpixels SP1 through SP6 which form each pixel P are assigned to two virtual pixels (which will be referred to herein as "first and second virtual pixels") VP1 and VP2. The first virtual pixel VP1 consists of four subpixels SP1, SP2, SP3 and SP4 among those six subpixels SP1 through SP6. On the other hand, the second virtual pixel VP2 consists of three subpixels SP4, SP5 and SP6. In the example shown in FIG. 8, the subpixel SP4 which is located in the fourth place as counted from the left to the right in the pixel P forms part of both of the first and second virtual pixels VP1 and VP2. That is to say, the first and second virtual pixels VP1 and VP2 include the same subpixel SP4 and share that subpixel SP4 in common.

According to the assignment pattern shown in FIG. 9, five subpixels SP1 through SP5 which form each pixel P are assigned to two virtual pixels (which will be referred to herein as "first and second virtual pixels") VP1 and VP2. The first virtual pixel VP1 consists of three subpixels SP1, SP2, and SP3 among those five subpixels SP1 through SP5. On the other hand, the second virtual pixel VP2 consists of three subpixels SP3, SP4 and SP5. In the example shown in FIG. 9, the subpixel SP3 which is located at the center of the pixel P forms part of both of the first and second virtual pixels VP1 and VP2. That is to say, the first and second virtual pixels VP1 and VP2 include the same subpixel SP3 and share that subpixel SP3 in common.

According to the assignment pattern shown in FIG. 10, four subpixels SP1 through SP4 which form each pixel P are assigned to two virtual pixels (which will be referred to herein as "first and second virtual pixels") VP1 and VP2. The first virtual pixel VP1 consists of three subpixels SP1, SP2, and SP3 among those four subpixels SP1 through SP4. On the other hand, the second virtual pixel VP2 consists of two subpixels SP3 and SP4. In the example shown in FIG. 10, the subpixel SP3 which is located in the third place as counted from the left to the right in the pixel P forms part of both of the first and second virtual pixels VP1 and VP2. That is to say, the first and second virtual pixels VP1 and VP2 include the same subpixel SP3 and share that subpixel SP3 in common.

Figure 11:
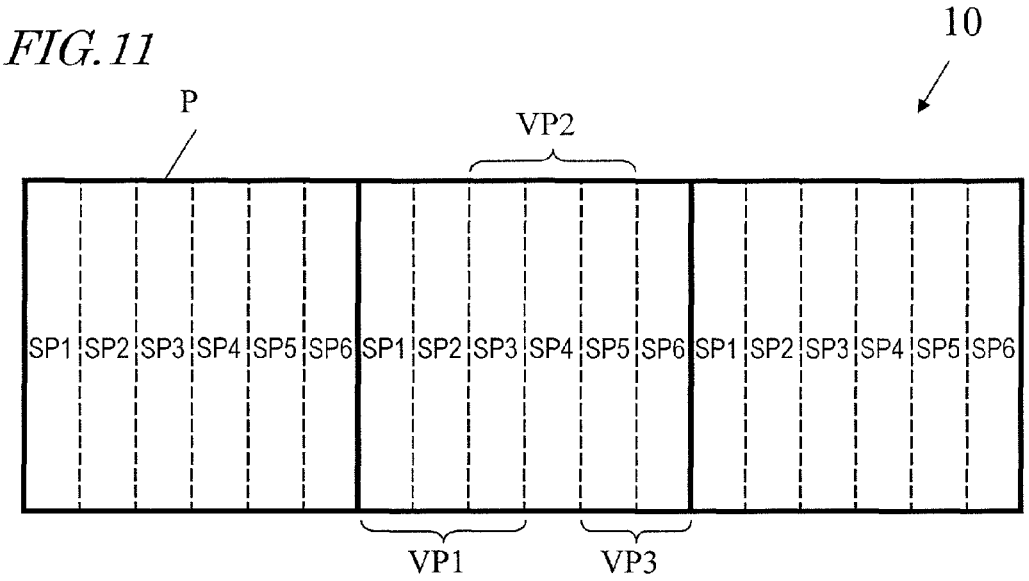
[FIG. 11] Illustrates yet another exemplary pattern of assigning multiple subpixels to a plurality of virtual pixels.

Although the number of virtual pixels is supposed to be two according to any of the exemplary assignment patterns shown in FIGS. 5 to 10, the number of virtual pixels does not have to be two but may also be three or more. FIG. 11 illustrates another exemplary assignment pattern.

According to the assignment pattern shown in FIG. 11, six subpixels SP1 through SP6 which form each pixel P are assigned to three virtual pixels (which will be referred to herein as "first, second and third virtual pixels") VP1, VP2 and VP3. The first virtual pixel VP1 consists of three subpixels SP1, SP2, and SP3 among those six subpixels SP1 through SP6. On the other hand, the second virtual pixel VP2 consists of three subpixels SP3, SP4 and SP5. And the third virtual pixel VP3 consists of two subpixels SP5 and SP6. In the example shown in FIG. 11, the subpixel SP3 which is located in the third place as counted from the left to the right in the pixel P forms part of both of the first and second virtual pixels VP1 and VP2. That is to say, the first and second virtual pixels VP1 and VP2 include the same subpixel SP3 and share that subpixel SP3 in common. In addition, the subpixel SP5 which is located in the fifth place as counted from the left to the right in the pixel P forms part of both of the second and third virtual pixels VP2 and VP3. That is to say, the second and third virtual pixels VP2 and VP3 include the same subpixel SP5 and share that subpixel SP5 in common.

Furthermore, according to any of the exemplary assignment patterns shown in FIGS. 5 through 11, each of the multiple virtual pixels is supposed to consist of at least two subpixels that are continuous with each other within a single pixel P. However, according to the present invention, such an assignment pattern does not have to be adopted. FIGS. 12 to 15 illustrate other exemplary assignment patterns.

Figure 12:
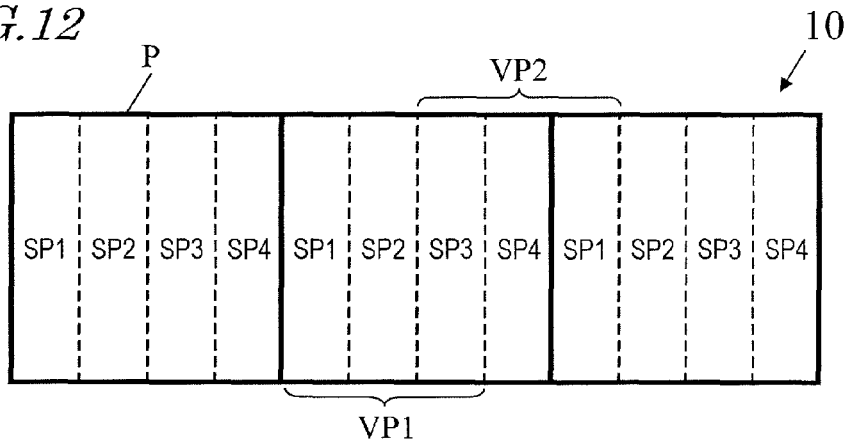
[FIG. 12] Illustrates yet another exemplary pattern of assigning multiple subpixels to a plurality of virtual pixels.

According to the assignment pattern shown in FIG. 12, multiple subpixels SP1 through SP4 are assigned to two virtual pixels VP1 and VP2. Also, according to the assignment pattern shown in FIG. 13, multiple subpixels SP1 through SP5 are assigned to two virtual pixels VP1 and VP2. Furthermore, according to the assignment pattern shown in FIG. 14, multiple subpixels SP1 through SP6 are assigned to two virtual pixels VP1 and VP2. And according to the assignment pattern shown in FIG. 15, multiple subpixels SP1 through SP6 are assigned to three virtual pixels VP1, VP2 and VP3.

Of the two virtual pixels VP1 and VP2 which are shown around the center in FIG. 12, the first virtual pixel VP1 is comprised of three subpixels SP1, SP2 and SP3 that form part of the center pixel P, while the second virtual pixel VP2 is comprised of two subpixels SP3 and SP4 that form part of the center pixel P and one subpixel SP1 that forms part of the pixel P on the right-hand side. In this example, the first virtual pixel VP1 shares the subpixel SP3 that is located in the third place as counted from the left to the right in the pixel P in common with the second virtual pixel VP2. On the other hand, the second virtual pixel VP2 shares the subpixel SP1 that is located in the leftmost place in the pixel P in common with another first virtual pixel VP1 (which is comprised of the three subpixels SP1, SP2 and SP3 that form part of the pixel P on the right-hand side).

Figure 13:
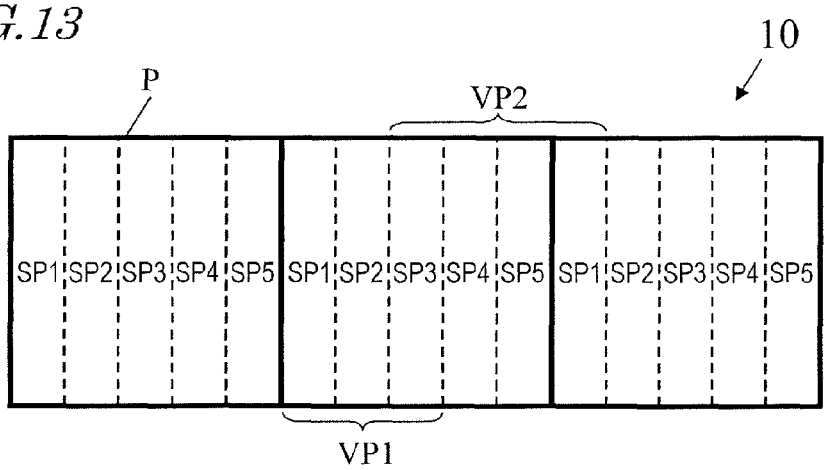
[FIG. 13] Illustrates yet another exemplary pattern of assigning multiple subpixels to a plurality of virtual pixels.

Of the two virtual pixels VP1 and VP2 which are shown around the center in FIG. 13, the first virtual pixel VP1 is comprised of three subpixels SP1, SP2 and SP3 that form part of the center pixel P, while the second virtual pixel VP2 is comprised of three subpixels SP3, SP4 and SP5 that form part of the center pixel P and one subpixel SP1 that forms part of the pixel P on the right-hand side. In this example, the first virtual pixel VP1 shares the subpixel SP3 that is located in the third place as counted from the left to the right in the pixel P in common with the second virtual pixel VP2. On the other hand, the second virtual pixel VP2 shares the subpixel SP1 that is located in the leftmost place in the pixel P in common with another first virtual pixel VP1 (which is comprised of the three subpixels SP1, SP2 and SP3 that form part of the pixel P on the right-hand side).

Figure 14:
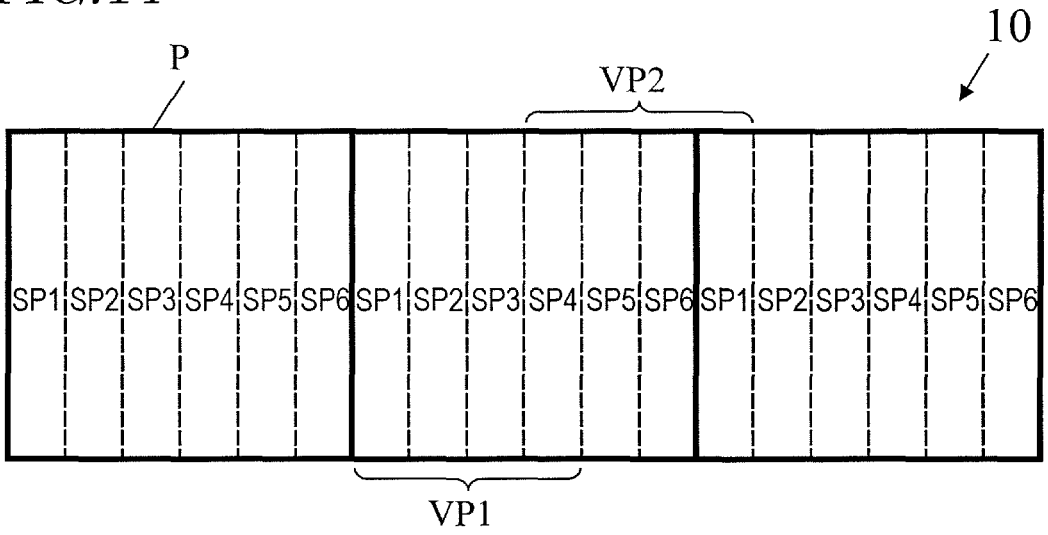
[FIG. 14] Illustrates yet another exemplary pattern of assigning multiple subpixels to a plurality of virtual pixels.

Of the two virtual pixels VP1 and VP2 which are shown around the center in FIG. 14, the first virtual pixel VP1 is comprised of four subpixels SP1, SP2, SP3 and SP4 that form part of the center pixel P, while the second virtual pixel VP2 is comprised of three subpixels SP4, SP5 and SP6 that form part of the center pixel P and one subpixel SP1 that forms part of the pixel P on the right-hand side. In this example, the first virtual pixel VP1 shares the subpixel SP4 that is located in the fourth place as counted from the left to the right in the pixel P in common with the second virtual pixel VP2. On the other hand, the second virtual pixel VP2 shares the subpixel SP1 that is located in the leftmost place in the pixel P in common with another first virtual pixel VP1 (which is comprised of the four subpixels SP1, SP2, SP3 and SP4 that form part of the pixel P on the right-hand side).

Figure 15:
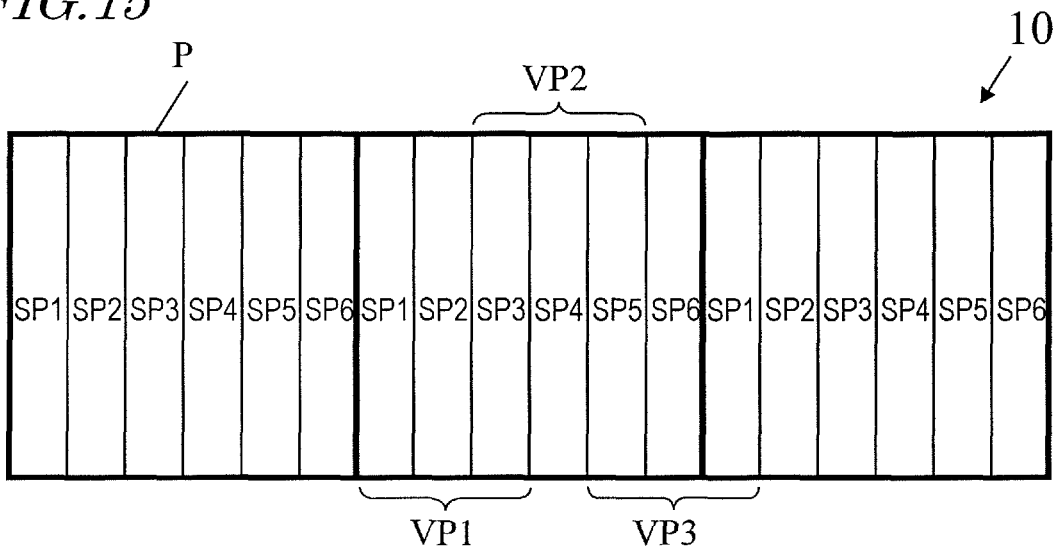
[FIG. 15] Illustrates yet another exemplary pattern of assigning multiple subpixels to a plurality of virtual pixels.

Of the three virtual pixels VP1, VP2 and VP3 which are shown around the center in FIG. 15, the first virtual pixel VP1 is comprised of three subpixels SP1, SP2, and SP3 that form part of the center pixel P, the second virtual pixel VP2 is comprised of three subpixels SP3, SP4, and SP5 that form part of the center pixel P, and the third virtual pixel VP3 is comprised of two subpixels SP5 and SP6 that form part of the center pixel P and one subpixel SP1 that forms part of the pixel P on the right-hand side. In this example, the first virtual pixel VP1 shares the subpixel SP3 that is located in the third place as counted from the left to the right in the pixel P in common with the second virtual pixel VP2. The second virtual pixel VP2 shares the subpixel SP5 that is located in the fifth place as counted from the left to the right in the pixel P in common with the third virtual pixel VP3. And the third virtual pixel VP3 shares the subpixel SP1 that is located in the leftmost place in the pixel P in common with another first virtual pixel VP1 (which is comprised of the three subpixels SP1, SP2, and SP3 that form part of the pixel P on the right-hand side).

In these examples shown in FIGS. 12 to 15, the second or third virtual pixel VP2 or VP3 is comprised of multiple consecutive subpixels that cover two pixels P. In this manner, some virtual pixel may cover two pixels P.

As described above, the liquid crystal display device 100 of this embodiment assigns multiple subpixels which form each pixel P to a plurality of virtual pixels and can conduct a display operation using each of those virtual pixels as a minimum color display unit. As a result, the display resolution (which is the resolution of an image to be displayed on the display screen) can be made higher than the panel resolution (which is the panel's own physical resolution that is defined by the total number of pixels P).

For example, according to the assignment patterns shown in FIGS. 5 to 10 and FIGS. 12 to 14, two virtual pixels VP1 and VP2 which are adjacent to each other in the row direction (i.e., horizontally) are formed with respect to each pixel P, and therefore, the display resolution can be doubled horizontally. Thus, an input image with a resolution "2A×B" can be displayed on a multi-primary-color display panel 10 with a panel resolution "A×B". Meanwhile, according to the assignment patterns shown in FIGS. 11 to 15, three virtual pixels VP1, VP2 and VP3 which are adjacent to each other in the row direction (i.e., horizontally) are formed with respect to each pixel P, and therefore, the display resolution can be tripled horizontally. Thus, an input image with a resolution "3A×B" can be displayed on the multi-primary-color display panel 10 with the panel resolution "A×B".

Consequently, even if the resolution of the input image is higher than the panel resolution, the liquid crystal display device 100 of this embodiment can also conduct a display operation as intended. Or the liquid crystal display device 100 can also display the input image in a smaller size in some area on the display screen.

As can be seen, the liquid crystal display device (as a multi-primary-color display device) 100 of this embodiment can make the display resolution higher than the panel resolution, and therefore, can display an image, of which the resolution is equal to or higher than that of a three-primary-color display device, at the same pixel size and same screen size as a three-primary-color display device, and can also be manufactured at a cost comparable to that of the three-primary-color display device.

In addition, the liquid crystal display device 100 is suitably able to change the patterns of assigning multiple subpixels to a plurality of virtual pixels. Then, the degree of increase in display resolution can be adjusted. For example, by changing from one of the assignment patterns shown in FIGS. 8 and 11 into the other, the degree of increase in horizontal display resolution can be switched between 2× and 3×.

It should be noted that "to change the patterns of assigning" subpixels means not just changing the number of virtual pixels per pixel P but also changing the number and combination of subpixels which form each virtual pixel as well. In some cases, it is difficult to reduce color differences (including a luminance difference and a chromaticity difference) between a plurality of virtual pixels to zero at the time of maximum output. However, by changing the number and combination of subpixels that form a single virtual pixel, either a set of virtual pixels with a smaller luminance difference or a set of virtual pixels with a smaller chromaticity difference can be selected appropriately according to the type of the input image or the purpose of display, for example.

When a display operation is conducted at a high resolution using virtual pixels, sometimes high-frequency components may not be able to be reproduced accurately enough according to the assignment pattern adopted. Thus, in order to achieve sufficiently accurate high-frequency component reproducibility, each of the plurality of virtual pixels should be comprised of only some of those subpixels (i.e., should not be comprised of all of those subpixels). Also, each of the plurality of virtual pixels should be comprised of at least two of those subpixels (i.e., should not consist of only one of those subpixels).

Furthermore, if each of the plurality of virtual pixels is comprised of two or more subpixels, those two or more subpixels that form each virtual pixel suitably include a subpixel to be shared with another virtual pixel (i.e., each virtual pixel should be assigned a subpixel representing the same primary color in common with another virtual pixel) as in the assignment patterns shown in FIGS. 8 to 15. By getting the same subpixel shared by a plurality of virtual pixels in this manner, the number and kinds of subpixels which form each virtual pixel can be increased, and therefore, each virtual pixel can achieve a sufficiently high luminance easily. As a result, any intended color (such as the color white) can be reproduced easily.

Figure 16:
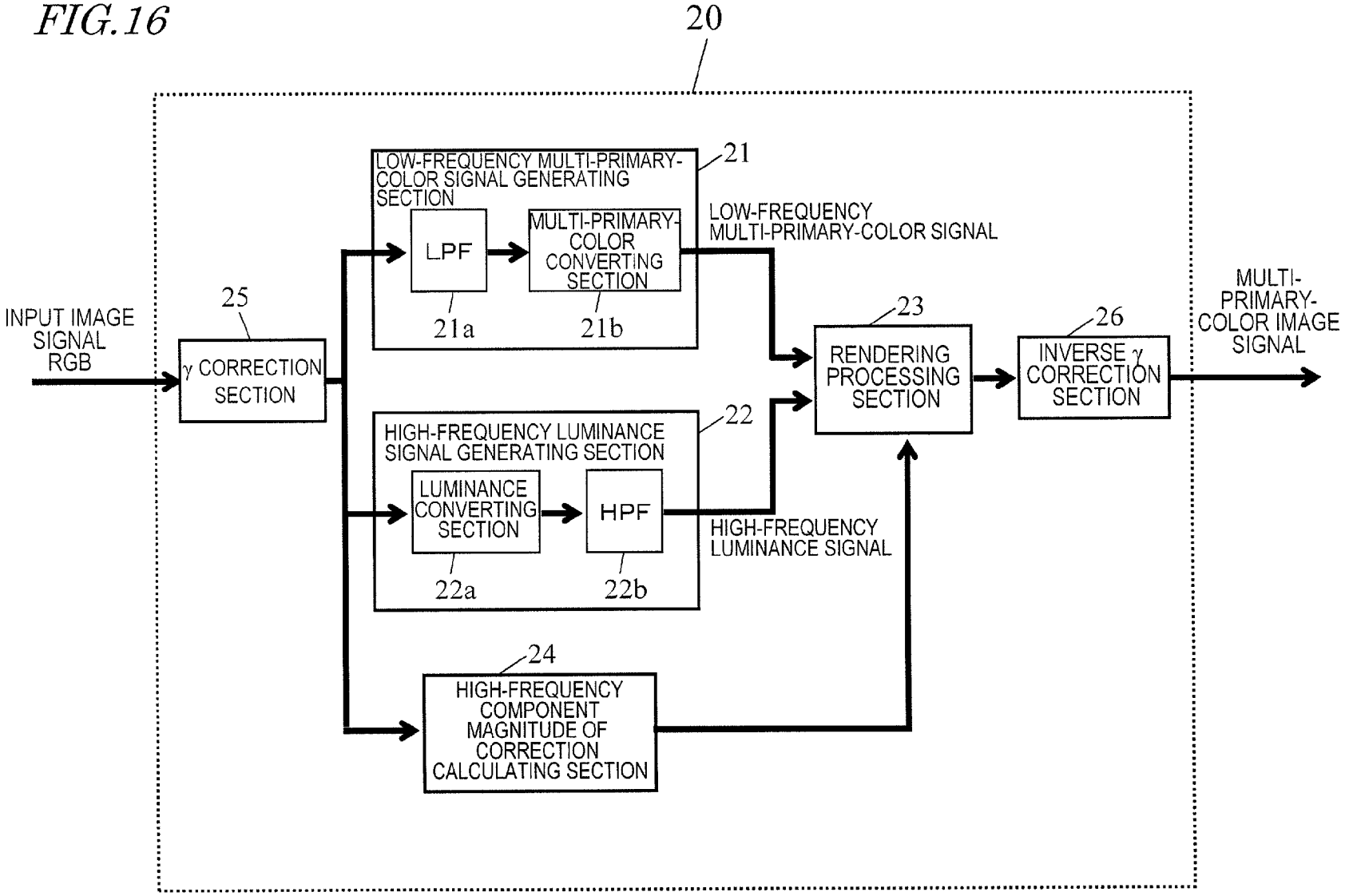
[FIG. 16] A block diagram illustrating a specific configuration for a signal converter 20 that the liquid crystal display device 100 has.

Next, a specific configuration for the signal converter 20 will be described. FIG. 16 illustrates an exemplary specific configuration for the signal converter 20.

As shown in FIG. 16, the signal converter 20 includes a low-frequency multi-primary-color signal generating section 21, a high-frequency luminance signal generating section 22, a rendering processing section 23, and a high-frequency component magnitude of correction calculating section 24. The signal converter 20 further includes a γ correction section 25 and an inverse γ correction section 26.

An image signal which has been input to the signal converter 20 is subjected to γ correction processing first by the γ correction section 25. Next, the γ corrected image signal is supplied to the low-frequency multi-primary-color signal generating section 21, the high-frequency luminance signal generating section 22 and the high-frequency component magnitude of correction calculating section 24.

The low-frequency multi-primary-color signal generating section 21 generates a low-frequency multi-primary-color signal based on the input image signal. The low-frequency multi-primary-color signal is a signal obtained by subjecting the low-frequency components of the input image signal (which are components with relatively low spatial frequencies) to multi-primary-color processing (for converting the low-frequency components so that the components represent four or more primary colors).

Specifically, the low-frequency multi-primary-color signal generating section 21 includes a low-frequency component extracting section (which is a low-pass filter (LPF) in this embodiment) 21*a* and a multi-primary-color converting section 21*b*. The low-pass filter 21*a* extracts low-frequency components from the input image signal. The low-frequency components of the input image signal that have been extracted by the low-pass filter 21*a* are converted into components representing multiple primary colors by the multi-primary-color converting section 21*b*. Those multi-primary-color converted low-frequency components are output as a low-frequency multi-primary-color signal. Any of various known techniques may be adopted as the multi-primary-color converting technique for the multi-primary-color converting section 21*b*. For example, the technique disclosed in PCT International Application Publication No. 2008/065935 or the technique disclosed in PCT International Application Publication No. 2007/097080 may be adopted.

The high-frequency luminance signal generating section 22 generates a high-frequency luminance signal based on the input image signal. The high-frequency luminance signal is a signal obtained by subjecting the high-frequency components of the input image signal (i.e., components with relatively high spatial frequencies) to a luminance conversion.

Specifically, the high-frequency luminance signal generating section 22 includes a luminance converting section 22*a* and a high-frequency component extracting section (which is a high-pass filter (HPF) in this embodiment) 22*b*. The luminance converting section 22*a* subjects the input image signal to a luminance convertion, thereby generating a luminance signal (or luminance components). The high-pass filter 22*b* extracts, as a high-frequency luminance signal, the high-frequency components of the luminance signal that has been generated by the luminance converting section 22*a*.

The rendering processing section 23 performs rendering processing on multiple virtual pixels based on the low-frequency multi-primary-color signal that has been generated by the low-frequency multi-primary-color signal generating section 21 and the high-frequency luminance signal that has been generated by the high-frequency luminance signal generating section 22. The liquid crystal display device 100 of this embodiment makes correction on the high-frequency luminance signal while performing this rendering processing. That is to say, a corrected high-frequency luminance signal is used to perform the rendering processing.

The high-frequency component magnitude of correction calculating section 24 (which will be simply referred to herein as the "magnitude of correction calculating section 24") calculates the magnitude of correction to be made on the high-frequency luminance signal during the rendering processing. Specifically, the magnitude of correction calculating section 24 calculates the magnitude of correction based on the input image signal. Typically, the magnitude of correction calculating section 24 calculates the magnitude of correction based on the hue of the color specified by the input image signal.

The image signal that has been generated as a result of the rendering processing is then subjected to an inverse γ correction by the inverse γ correction section 26 and output as a multi-primary-color image signal.

As can be seen, in view of the human visual property that exhibits higher sensitivity to a luminance signal rather than to a color signal (i.e., which has a lower luminosity factor to the color difference than to the luminance), the signal converter 20 of the liquid crystal display device 100 of this embodiment performs multi-primary-color conversion processing on the low-frequency components of the input image signal and luminance conversion processing on the high-frequency components, respectively. Then, the signal converter 20 combines together the low-frequency multi-primary-color signal and high-frequency luminance signal that have been obtained through these kinds of processing, and then performs rendering on the virtual pixels, thereby outputting an image signal representing four or more primary colors (as a multi-primary-color image signal).

In addition, the signal converter 20 of the liquid crystal display device 100 of this embodiment includes the magnitude of correction calculating section 24 which calculates the magnitude of correction to be made on the high-frequency luminance signal, and therefore, can perform the rendering processing using a high-frequency luminance signal thus corrected. Without such a magnitude of correction calculating section 24, if the input image includes an area that does have a chromaticity difference but has no luminance difference, the effect of increasing the resolution cannot be achieved as for that area. However, the liquid crystal display device 100 of this embodiment does have the magnitude of correction calculating section 24 as described above, and therefore, can achieve the effect of increasing the resolution even for that area. Hereinafter, the reason will be described specifically.

Figure 17:
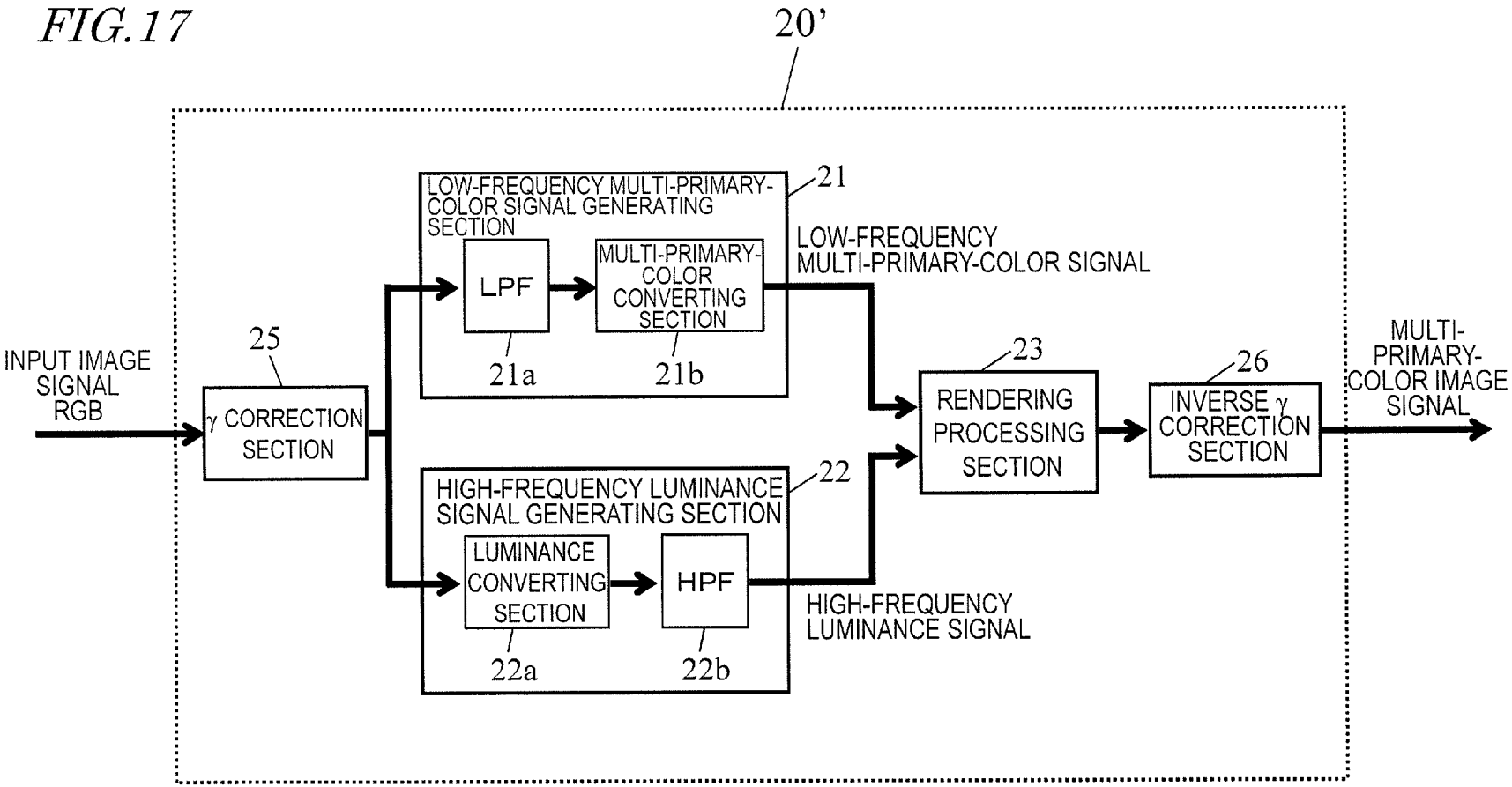
[FIG. 17] A block diagram illustrating a specific configuration for a signal converter 20' as a comparative example.

First of all, it will be described specifically how to perform rendering processing on the virtual pixels with reference to a situation where the signal converter 20' of the comparative example shown in FIG. 17 is used. The signal converter 20' of the comparative example shown in FIG. 17 has no magnitude of correction calculating section 24, which is difference from the signal converter 20 shown in FIG. 16. The signal converter 20' of the comparative example uses the uncorrected high-frequency luminance signal as it is in the rendering processing.

With the signal converter 20' of the comparative example adopted, if two virtual pixels are defined with respect to each pixel P (i.e., if multiple subpixels are assigned to first and second virtual pixels), a result V(n, m) of the rendering processing with those virtual pixels taken into consideration can be calculated by the following expression. In the following description, a configuration in which six subpixels representing mutually different primary colors are arranged in one row and six columns (i.e., arranged in line horizontally) in each pixel P is supposed to be used.

$$P(n, m) = L(n, m) + \alpha H(n) \quad \text{[Expression 1]}$$

$$V(n, m) = \begin{cases} W(1, m)P(2n, m) + W(2, m)P(2n-1, m) & (m = 1, 2, 3) \\ W(1, m)P(2n, m) + W(2, m)P(2n+1, m) & (m = 4, 5, 6) \end{cases}$$

In Expression (1), n indicates the location of a pixel in the row direction, m indicates the place of a subpixel in the pixel, L(n, m) represents the low-frequency component of the $m^{th}$ primary color at the pixel location n, and H(n) represents the high-frequency component of the luminance at the pixel location n. Also, P(n, m) represents a pixel value calculated based on L(n, m) and H(n), $\alpha$ represents a high-frequency component boosting coefficient (usually $\alpha$=1), and W(g, m) represents the weight of the $m^{th}$ primary color in the $g^{th}$ virtual pixel (and will be sometimes referred to herein as a "weight coefficient"). FIG. 18 shows low-frequency components, high-frequency components, pixel values, weights of respective primary colors at first virtual pixels, weights of respective primary colors at second virtual pixels, and the results of the rendering processing with those virtual pixels taken into consideration as for a portion of a certain row of pixels.

As can be seen from Expression (1) and FIG. 18, the pixel values of two pixels P(2n−1, m) and P(2n, m) or P(2n, m) and P(2n+1, m) on the input end have been rendered by two virtual pixels with respect to a single pixel on the output end (which is represented by the rendering result V(n, m)). That is to say, it can be seen that information about two pixels on the input end can be displayed by a single pixel on the output end.

FIG. 19 shows the pixel values and results of the rendering processing to be obtained when the $m^{th}$ primary color's weights W(1, m) and W(2, m) of the first and second virtual pixels are set as shown in the following Table 1. Also, FIGS. 20(*a*), 20(*b*) and 20(*c*) schematically illustrate portions of a certain row of pixels which are represented by the result of the rendering processing shown in FIG. 19 as for the input end, the input end (after having been subjected to the multi-primary-color conversion) and the output end, respectively.

TABLE 1

| m | 1 | 2 | 3 | 4 | 5 | 6 |
|---|---|---|---|---|---|---|
| W(1, m) | 0 | 0.5 | 1 | 1 | 0.5 | 0 |
| W(2, m) | 1 | 0.5 | 0 | 0 | 0.5 | 1 |

Each of the weights (i.e., weight coefficients) shown in Table 1 is set to be "0", "1" or "0.5". A subpixel which displays a primary color that has had its weight set to be 1 with respect to a virtual pixel can make all of the luminance that the subpixel can output contribute to the display of that virtual pixel. On the other hand, a subpixel which displays a primary color that has had its weight set to be 0 does not contribute to the display of that virtual pixel at all. In other words, it can be said that such a subpixel which displays a primary color that has had its weight set to be 0 does not form part of that virtual pixel. Meanwhile, a subpixel which displays a primary color that has had its weight set to be 0.5 can make a half of the luminance that the subpixel can output contribute to the display of that virtual pixel. Thus, subpixels which display primary colors that have had their weights set to be greater than 0 (but less than 1) with respect to multiple pixels do contribute to display of multiple virtual pixels, and therefore, are included in common in those multiple virtual pixels (i.e., shared by those multiple virtual pixels). If the weights are set as shown in Table 1, the first virtual pixel will be comprised of four subpixels representing the second, third, fourth and fifth primary colors and the second virtual pixel will be comprised of four subpixels representing the first, second, fifth and sixth primary colors.

Figure 20:
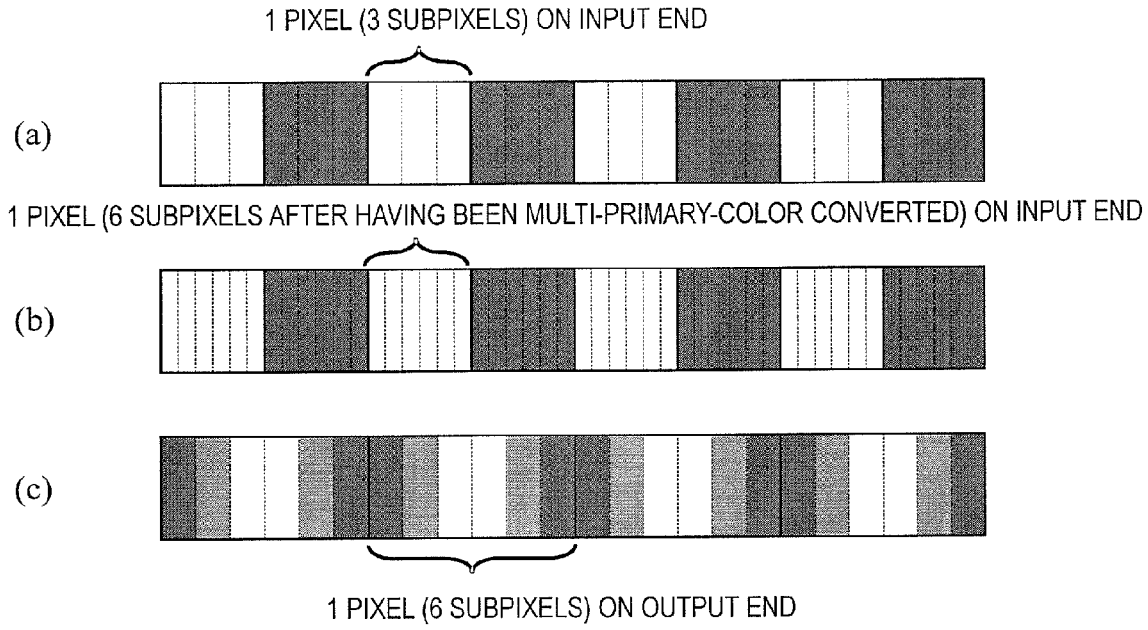
[FIG. 20] (*a*), (*b*) and (*c*) schematically illustrate portions of a certain row of pixels which are represented by the result of the rendering processing shown in FIG. 15 as for the input end, the input end (after having been subjected to the multi-primary-color conversion) and the output end, respectively.

In the examples illustrated in FIGS. 20(*a*) and 20(*b*), the size of a subpixel on the output end is the same as that of the subpixel on the input end. That is why the number of pixels on the output end is a half as large as that of pixels on the input end. To display an image of which the resolution is as high as the one on the input end, the size of a subpixel on the output end should originally be the same as that of the subpixel on the input end that has already been subjected to the multi-primary-color conversion as shown in FIG. 20(*b*). However, by performing the rendering processing using two virtual pixels, an image can be displayed on the output end where the subpixel size is the same as, and the number of pixels is a half as large as, on the input end at as high a resolution as on the input end as shown in FIG. 20(*c*).

As described above, by performing rendering processing with multiple virtual pixels taken into consideration for a single pixel P, the resolution on the display screen can be increased. It is known that the human visual property has relatively low sensitivity to a variation in color components and relatively high sensitivity to a variation in luminance components. According to the rendering processing technique described above, by performing such processing as to increase the resolution with respect to only the luminance components so to speak with such a property taken into account, the resolution can be increased with respect to the entire input image. That is why if the magnitude of the high-frequency luminance signal that has been output from the high-frequency luminance signal generating section 22 is zero (i.e., if there are no high-frequency components that have passed through the HPF 22*b*), no display operation will be conducted at an increased resolution.

There are two situations where there are no high-frequency components H(n).

One of the two is a situation where a so-called "solid-colored image" has been provided as an input image. In that case, there is only color information about low-frequency components and there is no luminance information that passes through the HPF 22*b*. In such a situation, however, there is no need to conduct a display operation at an increased resolution from the beginning, and therefore, the display operation can be conducted with no problem at all.

The other is a situation where the input image is not such a solid-colored image but an image which does have various kinds of color information but of which the luminance does not vary. That is to say, it is a situation where the input image is an image that does have a chromaticity difference but has no luminance difference. There are an infinite number of RGB combinations with arbitrary luminance values I, and therefore, there naturally is an image of which the chromaticity does vary but the luminance does not vary. If such an image has been input, there are no luminance components that pass through the HPF 22*b*, either. That is why in that case, a display operation should be, but is actually not, carried out at an increased resolution.

With the signal converter 20 of this embodiment (shown in FIG. 16) adopted, if two virtual pixels are defined with respect to each pixel P (i.e., if multiple subpixels are assigned to first and second virtual pixels), a result V(n, m) of the rendering processing with those virtual pixels taken into consideration can be calculated by the following expression. In the following description, a configuration in which six subpixels representing mutually different primary colors are arranged in one row and six columns (i.e., arranged in line horizontally) in each pixel P is supposed to be used.

$$P(n, m) = L(n, m) + \alpha H(n) + \beta C(n) \quad \text{[Expression 2]}$$

$$V(n, m) = \begin{cases} W(1, m)P(2n, m) + W(2, m)P(2n-1, m) & (m = 1, 2, 3) \\ W(1, m)P(2n, m) + W(2, m)P(2n+1, m) & (m = 4, 5, 6) \end{cases}$$

In this Expression (2), n, m, L(n, m), H(n), P(n, m), α and W(g, m) represent the same things as what have already been described. As can be seen when compared to a situation where the signal converter 20' of the comparative example is used, if the signal converter 20 of this embodiment is used, the magnitude of correction C(n) to be made on the high-frequency luminance signal (i.e., high-frequency components) and a weight coefficient β (usually β=1) with respect to that magnitude of correction C(n) have been added to the expression representing the pixel value P(n, m). As already described, the magnitude of correction C(n) is calculated by the magnitude of correction calculating section 24. FIG. 21 shows low-frequency components, high-frequency components, the magnitudes of correction to be made on the high-frequency components, pixel values, weights of respective primary colors at first virtual pixels, weights of respective primary colors at second virtual pixels, and the results of the rendering processing with those virtual pixels taken into consideration as for a portion of a certain row of pixels.

As can be seen from Expression (2) and FIG. 21, the pixel values of two pixels P(2n−1, m) and P(2n, m) or P(2n, m) and P(2n+1, m) on the input end have been rendered by two virtual pixels with respect to a single pixel on the output end (which is represented by the rendering result V(n, m)). That is to say, it can be seen that information about two pixels on the input end can be displayed by a single pixel on the output end.

In addition, if the signal converter 20 of this embodiment is used, the pixel value P(n, m) can be based on the magnitude of correction C(n). As a result, as for an area which does have a chromaticity difference but has no luminance difference, a luminance difference pattern can be generated so as to enhance a pattern based on the chromaticity difference. That is to say, the chromaticity difference pattern included in the input image can be incorporated as a luminance difference pattern into the output image. Consequently, even for such an area which does have a chromaticity difference but has no luminance difference, the resolution can also be increased effectively.

Hereinafter, specific exemplary methods for calculating the magnitude of correction using the magnitude of correction calculating section 24 of the signal converter 20 will be described.

EXAMPLE 1

In a first example, the magnitude of correction calculating section 24 calculates the magnitude of correction according to the hue of the color specified by the input image signal. The magnitude of correction calculated by the magnitude of correction calculating section 24 has a positive value if the color specified by the input image signal is an expansive color and has a negative value if the color specified by the input image signal is a contractive color. Also, the magnitude of correction calculated by the magnitude of correction calculating section 24 is zero if the color specified by the input image signal is an achromatic color.

In this description, the "expansive color" is a color that makes something look bigger than its actual area, and is a warm color such as the color red. On the other hand, the "contractive color" is a color that makes something look smaller than its actual area and is a cold color such as the color blue.

Hereinafter, it will be described more specifically.

In this example, the magnitude of correction calculating section 24 calculates the hue based on the grayscale levels R, G and B of the color red, green and blue represented by the input image signal (i.e., based on input grayscale levels), thereby determining whether the color specified by the input image signal is an expansive color or a contractive color.

First of all, based on the input grayscale levels R, G and B of the colors red, green and blue, the hue H and saturation S of the colors reproduced by them are calculated simply. For that purpose, the following calculation expressions may be used. In the following expressions, the input levels R, G and B are supposed to be normalized to fall within the range of 0 to 1:

$$M = \max(R, G, B) \quad \text{[Expression 3]}$$

$$m = \min(R, G, B)$$

$$L = (M + m)/2$$

$$(M = m)$$

$$S = 0$$

$$H = 0$$

$$(M \neq m)$$

$$S = \begin{cases} (M - m)/(M + m) & L \leq 0.5 \\ (M - m)/(2 - M - m) & L > 0.5 \end{cases}$$

$$r = (M - R)/(M - m)$$

$$g = (M - G)/(M - m)$$

$$b = (M - B)/(M - m)$$

$$h = \begin{cases} b - g & R = M \\ 2 + r - b & G = M \\ 4 + g - r & B = M \end{cases}$$

$$H = 60h + 360n$$

Figure 22:
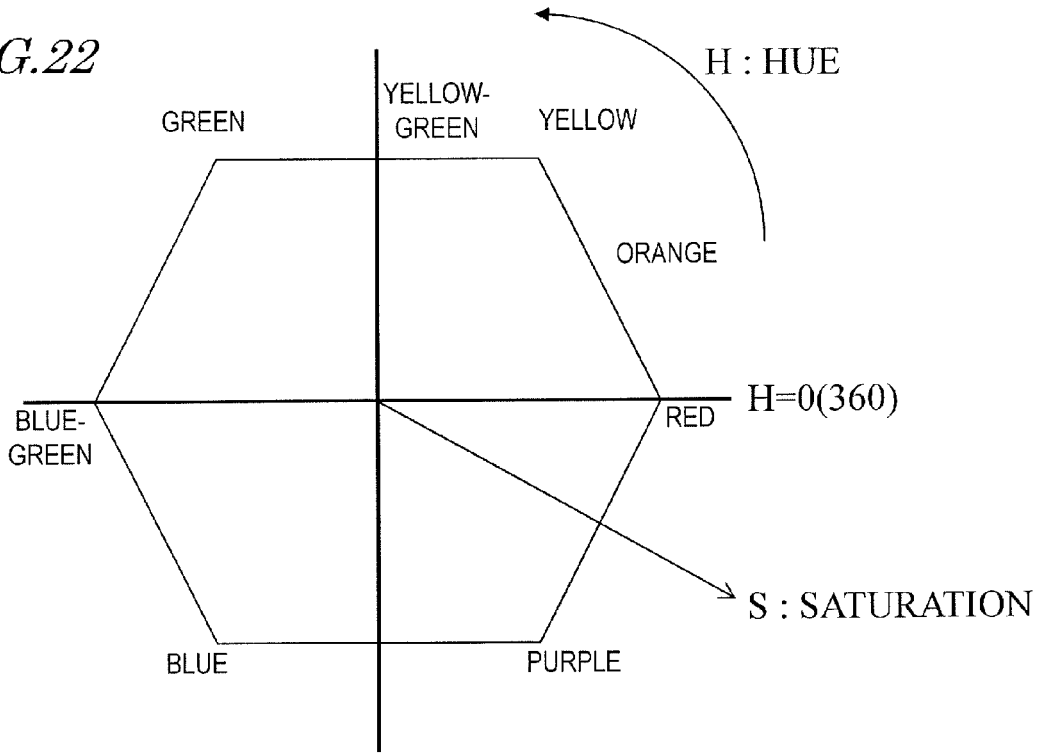
[FIG. 22] Shows an SH plane at a certain lightness L.

In these expressions, L represents the lightness and n is supposed to be given so that H falls within the range of 0 to less than 360. By working out these calculation expressions, conversion from the RGB color space into the HSL color space (based on the Ostwald color system) can be carried out. FIG. 22 shows an SH plane at a certain lightness L. As can be seen from FIG. 22, in the HLS color space, the hue H is represented as an angle and the saturation S is represented as a distance from the center.

Subsequently, based on a function F(H) that returns the degree of expansion or contraction from the hue H and the saturation S, the magnitude of correction C to be made on the high-frequency components is defined by the following expression:

$$C = acS \cdot F(H) \quad \text{[Expression 4]}$$

In this Expression (4), c is a coefficient that determines the intensity of correction, and is set to be a value of around the $(n-4)^{th}$ power of two (e.g., c=16 in the case of an eight-bit system) in an n-bit system (where n is equal to or greater than 8). Since S has a value of 0 to 1, a (to be described later) has a value of 0 to 1, and F(H) has a value of −1 to +1, c means the maximum absolute value of the magnitude of correction.

The function F(H) returns a maximum value of +1 as for the most expansive hue and a minimum value of −1 as for the most contractive hue. This function has not been turned into a general numerical expression, but may have its shape determined through the experiment to be described below, for example.

<Experiment for Determining Shape of Function F(H)>

[1] N color samples, each having a predetermined lightness L, a predetermined saturation S and an arbitrary hue H, are prepared. As such color samples, the colors red, green, blue, and yellow which are primary colors according to the opponent color theory and the colors orange, purple, blue-green and yellow-green which are their intermediate colors may be used. These colors are sorted in the order of their hues as Color Samples 1, 2, . . . and N and their hues are indicated by H(1), H(2), . . . and H(N), respectively.

Figure 23:
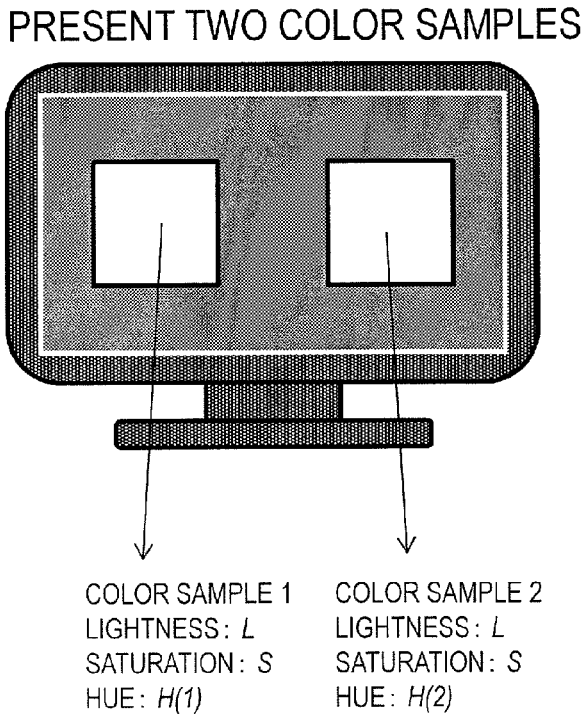
[FIG. 23] Schematically shows how two color samples are presented to a subject.

[2] Two are selected from the N color samples and presented to each subject using an achromatic color as a background as shown in FIG. 23. In this case, the areas of the two color samples need to agree with each other. In the example shown in FIG. 23, Color Sample 1 (with a lightness L, a saturation S and a hue H(1)) and Color Sample 2 (with a lightness L, a saturation S and a hue H(2)) are supposed to be presented.

[3] The subject is asked which of the two color samples presented looks more expansive for him or her than the other. And this question will be asked the same number of times as the number of combinations of color samples. It should be noted that the number of combinations is N (N−1)/2.

[4] The answers are collected from a lot of subjects. As a result, the proportion p (n1>n2) of the subjects who answered that the color sample n1 looked more expansive for them when the color samples n1 and n2 were compared to each other can be obtained. For example, according to the aggregate results shown in the following Table 2, 41 out of 50 subjects answered that the color sample n1 looked more expansive for them when the color samples n1 and n2 were compared to each other. Thus, p (n1>n2) is 0.82 (=41/50). It should be noted that the sum of the proportion p (n1>n2) of the subjects who answered that the color sample n1 looked more expansive for them and the proportion p (n2>n1) of the subjects who answered that the color sample n2 looked more expansive for them becomes equal to one (i.e., p (n1>n2)+p (n2>n1)=1).

TABLE 2

| Color sample # | 1 | 2 | . . . | N |
|---|---|---|---|---|
| 1 | — | 41 | . . . | 45 |
| 2 | 9 | — | . . . | 38 |
| . . . | . . . | . . . | . . . | . . . |
| N | 5 | 12 | . . . | — |

[5] By statistically processing "p" that has been obtained as a result of these experiments, a psychological quantity indicating the degree of expansion and contraction of each color sample can be represented as a numerical value (i.e., by one measure). It should be noted that the method that has been described in [2] through [5] is sometimes called a "paired comparison method".

[6] The value of F(H) is normalized so that F (H(Nmax)) =+1 is satisfied with respect to the hue H(Nmax) of a color sample Nmax that the largest number of subjects answered looked more expansive and that F (H(Nmin))=−1 is satisfied with respect to the hue H(Nmin) of a color sample Nmin that the smallest number of subjects answered looked more expansive.

[7] By making interpolation between the respective phases based on the N values F(H(1)), F(H(2)), . . . and F(H(N)), every F(H) value is determined.

In this manner, the function F(H) can be defined. In FIG. 22, shown are the locations of the exemplary color samples mentioned in [1] on the SH plane. The larger the number of color samples, the higher the accuracy of F(H) but the more significantly the cost of doing those experiments rises, too. That is why the number of the color samples is determined by comparing the intended accuracy of F(H) and the cost of doing the experiments to each other.

Also, in Expression (4) mentioned above is determined by the absolute value of the high-frequency component H(n). The correction is suitably made only on a range with no luminance difference. That is why if the absolute value of the high-frequency component H(n) is larger than a threshold value th (i.e., if |H(n)|>th), "a" is zero (i.e., a=0). If the absolute value of the high-frequency component H(n) is zero (i.e., if |H(n)|=0), "a" is the maximum value of 1 (i.e., a=1). And if the absolute value of the high-frequency component H(n) is larger than zero but equal to or smaller than the threshold value th (i.e., if 0<|H(n)|≤th), "a" is an intermediate value (i.e., a value which is larger than zero but smaller than one). The threshold value th is set to be a value of around the $(n-^{6})^{th}$ power of two in an n-bit system (where n is equal to or greater than 8) and may be set to be four in an eight-bit system (which conducts a display operation in 256 grayscale levels).

Figures 24, 25:
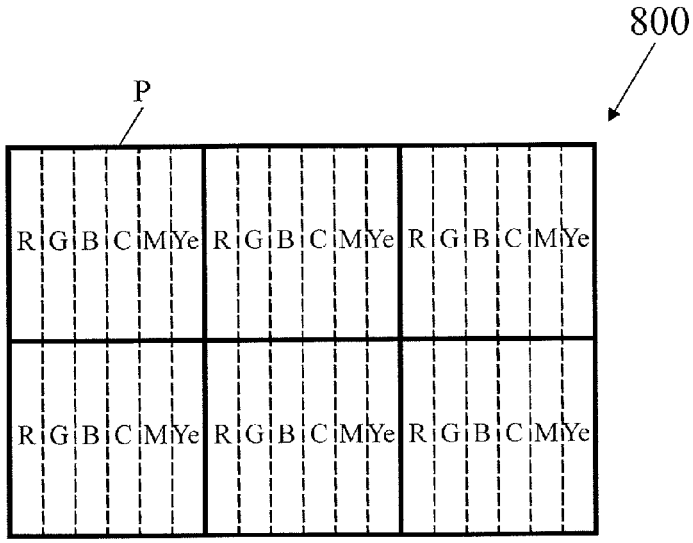
[FIG. 24] Shows the results of intermediate processing in three different situations where the image is contracted by a conventional method, by using the signal converter 20' of the comparative example, and by the technique of Example 1 using the signal converter 20 of this embodiment, respectively.
[FIG. 25] Schematically illustrates a conventional display device 800 which conducts a display operation using six primary colors.

FIG. 24 shows the results of intermediate processing in three different situations where the image is contracted by a conventional method, by using the signal converter 20' of the comparative example, and by the technique of Example 1 using the signal converter 20 of this embodiment, respectively.

In this case, the input image signal has been subjected to a γ correction and the colors red, green and blue grayscale levels R, G and B represented by the input image signal and luminance signal I are values in a linear color space and luminance space.

According to an ordinary image contracting technique, the input image signal is passed through a low-pass filter and then pixel values are sampled according to the rate of contraction in order to reduce false signals to be caused by aliasing. On the left-hand side of FIG. 24, shown is the results of processing that adopted such a conventional general image contraction technique. In the example shown on the left-hand side of FIG. 24, the input image signal (in three colors) is subjected to a low-pass filter and then only odd-numbered columns of the input image signal are sampled, thereby contracting the signal to a half. As a result, the image signal (including three color low-frequency components) comes to have a solid-colored pattern such as (R, G, B)=(127, 127, 127), and the chromaticity difference pattern depending on the input image is lost. If the image needs to be output to a multi-primary-color display device, the three-color low-frequency components are further converted into a multi-primary-color signal. Even so, it is still true that the chromaticity difference pattern has been lost.

In the middle of FIG. 24, shown are the results of processing that used the signal converter 20' of the comparative example. In that case, the three-color low-frequency components are the same as in a situation where the conventional method is adopted. However, by performing rendering processing with the high-frequency components held, a display operation can be carried out with the resolution increased. Nevertheless, even if the input image has a chromaticity difference pattern, the input image does not always have a luminance difference pattern. In the example shown in FIG. 24, if the input image signal is converted into a luminance signal, a solid-colored pattern with I=127 will be obtained as a result. Although the signal converter 20' tries to generate a high-frequency luminance signal by subjecting this luminance signal to the HPF 22*b*, the resultant high-frequency luminance signal (i.e., the high-frequency components of the luminance signal) comes to have a solid-colored pattern with H=0, too. After the three-color low-frequency components are converted into multi-primary-color components, rendering processing is carried out in order to output the signal to the multi-primary-color display device. However, the display operation cannot be carried out at an increased resolution but a 127-grayscale solid-colored pattern in gray will be output.

On the right-hand side of FIG. 24, shown are the results of processing that were obtained by applying the technique of Example 1 to the signal converter 20 of this embodiment. The same three-color low-frequency components and same high-frequency luminance signal (i.e., high-frequency components of the luminance signal) were obtained as in a situation where the signal converter 20' of the comparative example was used. In this case, however, the magnitude of correction calculating section 24 calculates the magnitude of correction based on the input image signal by the technique of Example 1. According to the calculation expressions in Expression (3), (S, H)=(0.9677, 141) is obtained in pixels where (R, G, B)=(3, 183, 65) and (S, H)=(0.9574, 321) is obtained in pixels where (R, G, (251, 71, 189). As a result, the magnitudes of correction C to be made on the high-frequency components are calculated by the calculation expression of Expression (4) to 0 and 15, respectively. Thereafter, the three-color low-frequency components are converted into multi-primary-color components, which are then output, along with the high-frequency luminance signal and magnitude of correction on the high-frequency components, to the rendering processing section 23. Then, by performing the rendering processing as described above, a luminance difference corresponding to the magnitude of correction C is generated. According to this technique, the chromaticity difference pattern that was included in the input image is still lost and an overall gray image is also generated. However, the chromaticity difference pattern is converted into a luminance difference pattern and a luminance difference pattern is generated in the output image. As a result, the resolution can be increased effectively.

According to the technique of Example 1, the magnitude of correction C(n) to be made on the high-frequency components is calculated by determining whether the color of a pixel of interest is an expansive color or a contractive color. However, the magnitude of correction C(n) does not have to be calculated by this method but may also be calculated by the technique of Example 2 or 3 to be described below.

EXAMPLE 2

In a second example, the value of the hue H is calculated based on the colors red, green and blue grayscale levels R, G and B represented by the input image signal (i.e., input grayscale levels). To calculate the hue H, an angle to be defined by chromaticities a* and b* may be used after the RGB color space has been converted into the L*a*b* color space.

Also, in this example, a lookup table (LUT) is referred to based on the calculated value of the hue H, thereby determining the magnitude of correction C(n). The LUT stores data about the magnitude of correction associated with the hue H. Optionally, as reference keys to the LUT, not only the hue but also the saturation may be used in combination.

Alternatively, the magnitude of correction C(n) may also be determined directly by using the RGB values of the input image signal as a reference key.

EXAMPLE 3

According to the techniques of Examples 1 and 2 described above, the magnitude of correction C(n) is calculated with respect to a pixel of interest alone. However, the magnitude of correction C(n) may also be calculated based on the difference between the pixel of interest and pixels surrounding it. For example, a pixel of interest may be compared to two pixels which are located on the left- and right-hand sides of the pixel of interest, and then given a positive magnitude of correction if its color has the greatest degree of expansion or a negative magnitude of correction if its color has the greatest degree of contraction. To carry out this method, the degree of expansion or contraction should be determined uniquely based on the RGB values of the input image signal. For that purpose, the LUT may be referred to after the value of the hue H has been calculated.

INDUSTRIAL APPLICABILITY

Embodiments of the present invention provide a multi-primary-color display device which can display an image, of which the resolution is equal to or higher than that of a three-primary-color display device, without reducing the size of each subpixel compared to the three-primary-color display device. In addition, according to the present invention, in a situation where a display operation is conducted using a plurality of virtual pixels in order to increase the resolution, the resolution can also be increased even in an area which does have a chromaticity difference but has no luminance difference. A multi-primary-color display device according to the present invention can conduct a display operation, of which the quality is high enough to use it in liquid crystal TV sets and various other electronic devices effectively.

REFERENCE SIGNS LIST

10 multi-primary-color display panel
20 signal converter
21 low-frequency multi-primary-color signal generating section
21*a* low-pass filter (low-frequency component extracting section)
21*b* multi-primary-color converting section
22 high-frequency luminance signal generating section
22*a* luminance converting section
22*b* high-pass filter (high-frequency component extracting section)
23 rendering processing section
24 high-frequency component magnitude of correction calculating section
25 γ correction section
26 inverse γ correction section
100 liquid crystal display device (multi-primary-color display device)
P pixel
SP1 to SP6 subpixel
R red subpixel
G green subpixel
B blue subpixel
C cyan subpixel M magenta subpixel
Ye yellow subpixel
VP1 first virtual pixel
VP2 second virtual pixel
VP3 third virtual pixel

The invention claimed is:

1. A multi-primary-color display device comprising a plurality of pixels which are arranged in columns and rows to form a matrix pattern, each of the plurality of pixels being comprised of a plurality of subpixels that represent mutually different colors and that include at least four subpixels, the device further comprising:

a multi-primary-color display panel in which each of the plurality of pixels is comprised of the plurality of subpixels; and a signal converter which converts an input image signal representing the three primary colors into a multi-primary-color image signal representing four or more primary colors, wherein the display device assigns the plurality of subpixels that form each said pixel to a plurality of virtual pixels and is able to conduct a display operation using each of the plurality of virtual pixels as a minimum color display unit, the signal converter includes:

a low-frequency multi-primary-color signal generating section which generates, based on the input image signal, a low-frequency multi-primary-color signal that is a signal obtained by converting low-frequency components of the input image signal into multiple primary colors;

a high-frequency luminance signal generating section which generates, based on the input image signal, a high-frequency luminance signal that is a signal obtained by converting high-frequency components of the input image signal into a luminance; and a rendering processing section which performs rendering processing on the plurality of virtual pixels based on the low-frequency multi-primary-color signal and the high-frequency luminance signal, and the signal converter further includes a magnitude of correction calculating section which calculates, based on the input image signal, the magnitude of correction to be made on the high-frequency luminance signal during the rendering processing.

2. The multi-primary-color display device of claim 1, wherein the magnitude of correction calculating section calculates the magnitude of correction based on the hue of a color specified by the input image signal.

3. The multi-primary-color display device of claim 2, wherein the magnitude of correction to be calculated by the magnitude of correction calculating section has a positive value if the color specified by the input image signal is an expansive color and has a negative value if the color specified by the input image signal is a contractive color.

4. The multi-primary-color display device of claim 2, wherein if the color specified by the input image signal is an achromatic color, the magnitude of correction calculated by the magnitude of correction calculating section is zero.

5. The multi-primary-color display device of claim 1, wherein the low-frequency multi-primary-color signal generating section includes:

a low-frequency component extracting section which extracts low-frequency components from the input image signal; and a multi-primary-color converting section which converts the low-frequency components that have been extracted by the low-frequency component extracting section into multiple primary colors.

6. The multi-primary-color display device of claim 1, wherein the high-frequency luminance signal generating section includes:

a luminance converting section which generates a luminance signal by subjecting the input image signal to a luminance conversion; and a high-frequency component extracting section which extracts, as the high-frequency luminance signal, high-frequency components of the luminance signal that have been generated by the luminance converting section.

7. The multi-primary-color display device of claim 1, wherein the pattern of assigning the plurality of subpixels to the plurality of virtual pixels is changeable.

8. The multi-primary-color display device of claim 1, wherein each of the plurality of virtual pixels is comprised of at least two of the plurality of subpixels.

9. The multi-primary-color display device of claim 1, wherein the rows run substantially parallel to a horizontal direction on a display screen, and in each of the plurality of pixels, the plurality of subpixels are arranged in one row and multiple columns.

10. The multi-primary-color display device of claim 1, wherein the plurality of subpixels includes red, green and blue subpixels representing the colors red, green and blue, respectively.

11. The multi-primary-color display device of claim 10, wherein the plurality of subpixels further includes at least one of cyan, magenta, yellow and white subpixels representing the colors cyan, magenta, yellow and white, respectively.

12. The multi-primary-color display device of claim 10, wherein the plurality of subpixels includes another red subpixel representing the color red.

13. The multi-primary-color display device of claim 1, wherein the display device is a liquid crystal display device.

* * * * *